US010882205B2

(12) United States Patent
Charest et al.

(10) Patent No.: US 10,882,205 B2
(45) Date of Patent: Jan. 5, 2021

(54) POST AND BEAM CUTTING DEVICE

(71) Applicant: Connecticut Post & Beam LLC, Winchester Center, CT (US)

(72) Inventors: Peter J. Charest, North Port, FL (US); Laurie Sharp, St. Petersburg, FL (US)

(73) Assignee: Connext Post & Beam, LLC, St. Petersburg, FL (US)

( * ) Notice: Subject to any disclaimer, the term of this patent is extended or adjusted under 35 U.S.C. 154(b) by 131 days.

(21) Appl. No.: 15/873,332

(22) Filed: Jan. 17, 2018

(65) Prior Publication Data

US 2018/0141233 A1 May 24, 2018

Related U.S. Application Data

(63) Continuation-in-part of application No. 15/060,674, filed on Mar. 4, 2016, now Pat. No. 9,920,531.

(60) Provisional application No. 62/130,280, filed on Mar. 9, 2015.

(51) Int. Cl.

| | |
|---|---|
| ***B27B 17/00*** | (2006.01) |
| ***B27B 17/02*** | (2006.01) |
| ***E04G 21/16*** | (2006.01) |
| *E04B 1/26* | (2006.01) |

(52) U.S. Cl.

CPC ..... *B27B 17/0083* (2013.01); *B27B 17/02* (2013.01); *E04G 21/16* (2013.01); *E04B 2001/2648* (2013.01)

(58) Field of Classification Search

CPC . B27B 17/0058; B27B 17/0083; B27B 29/04; B27B 17/08; B27B 17/005; B27B 17/0066; B27B 17/02; B23Q 9/005; B23Q 1/0054; B23Q 9/0014; B23H 1/0078; B23D 45/006; B23D 47/02; B23D 57/02–023; E04B 2001/2648; E04G 21/16

USPC ..... 33/499

See application file for complete search history.

(56) References Cited

U.S. PATENT DOCUMENTS

| | | | | | |
|---|---|---|---|---|---|
| 658,262 | A * | 9/1900 | Hester | G01B 3/566 | 33/499 |
| 1,351,527 | A * | 8/1920 | Cabrera Lopez | B43L 7/12 | 33/499 |
| 1,535,042 | A * | 4/1925 | Dudley | B27G 5/02 | 83/745 |
| 1,855,945 | A * | 4/1932 | Denyer | B27G 5/02 | 83/745 |

(Continued)

*Primary Examiner* — Jason Daniel Prone
*Assistant Examiner* — Samuel A Davies
(74) *Attorney, Agent, or Firm* — Leydig, Voit & Mayer, Ltd.

(57) ABSTRACT

A beam has an upper face, a lower face, side faces, and an end face. The end face has a rectangular configuration and is vertically disposed. The end face has a slot vertically disposed and parallel with, and equally spaced from, the side faces. Beam holes extend through the beam on opposite sides of the slot. A post has a front face, a parallel rear face, and parallel side faces. A connector has a first section and a second section. Beam apertures are formed in the first section. The first section is positioned in the slot with the beam apertures aligned with the beam holes. The second section is attached to the post. Dowels extend through the beam holes and the beam apertures thereby coupling the beam to the post. The system also includes tools for accurately cutting and drilling components, wood and otherwise, to be coupled.

11 Claims, 19 Drawing Sheets

(56) References Cited

U.S. PATENT DOCUMENTS 2,435,529 A * 2/1948 Brockley ..... B43L 7/005 33/468
2,620,835 A * 12/1952 Barnhart ..... B23Q 9/0085 83/574
2,661,034 A * 12/1953 MacDonald ..... B23Q 9/005 33/497
2,930,416 A 3/1960 Granberg
2,942,633 A * 6/1960 King ..... B23Q 9/0014 83/745
3,225,799 A 12/1965 Hayden et al.
3,757,628 A * 9/1973 Camacho ..... B23Q 9/0014 83/745
3,796,113 A 3/1974 Granberg
3,845,556 A * 11/1974 Edmunson ..... B27B 17/0083 30/381
3,864,830 A * 2/1975 Haddon ..... B23Q 9/0021 30/371
3,965,788 A 6/1976 Granberg
4,002,089 A 1/1977 Granberg
4,070,757 A 1/1978 Granbeg et al.
4,608,898 A * 9/1986 Volk ..... B23Q 9/005 269/1
4,611,407 A * 9/1986 van Gorp ..... B43L 7/005 33/471
4,726,274 A * 2/1988 Pitoni ..... B23Q 9/0014 83/574
5,078,119 A * 1/1992 Holmes ..... B23Q 9/0014 125/13.01
5,713,134 A * 2/1998 Stevens ..... B23Q 9/0014 30/376
6,192,592 B1 * 2/2001 Zimmerman ..... B23Q 9/0028 30/371
6,752,059 B1 * 6/2004 Posont ..... B23Q 9/005 33/499
2008/0034596 A1 * 2/2008 Barnes ..... B23Q 9/0042 30/373
2013/0160630 A1 * 6/2013 Groth ..... B23D 45/006 83/743

* cited by examiner

FIG 3
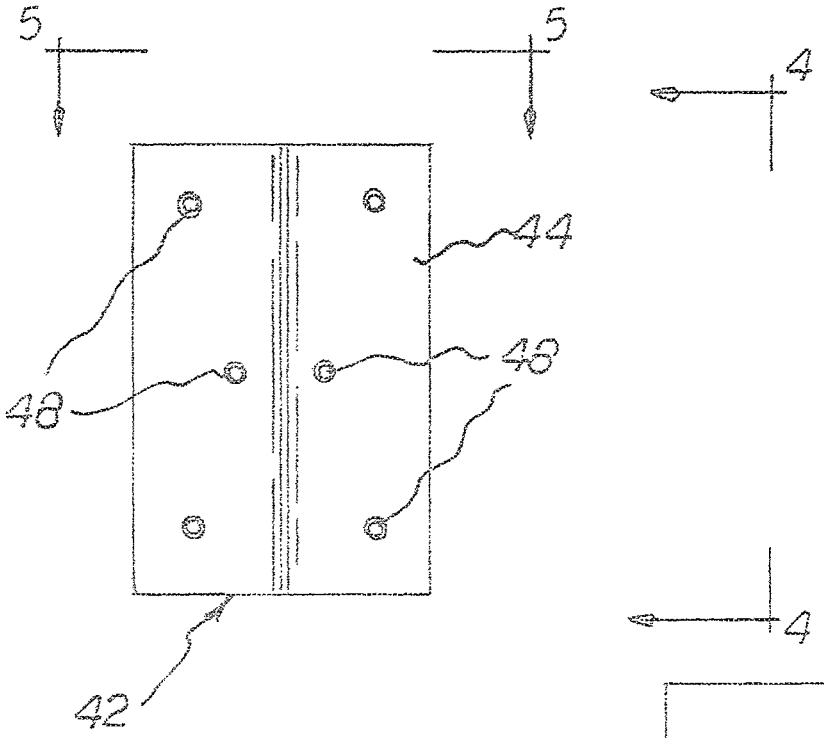
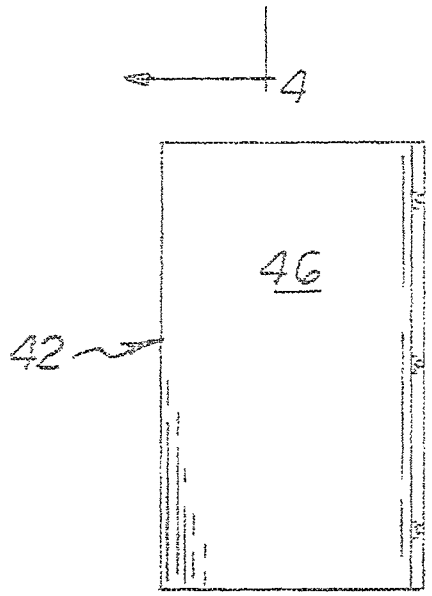
FIG 4
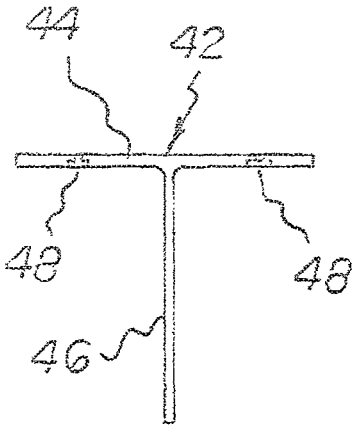
FIG 5

FIG 6
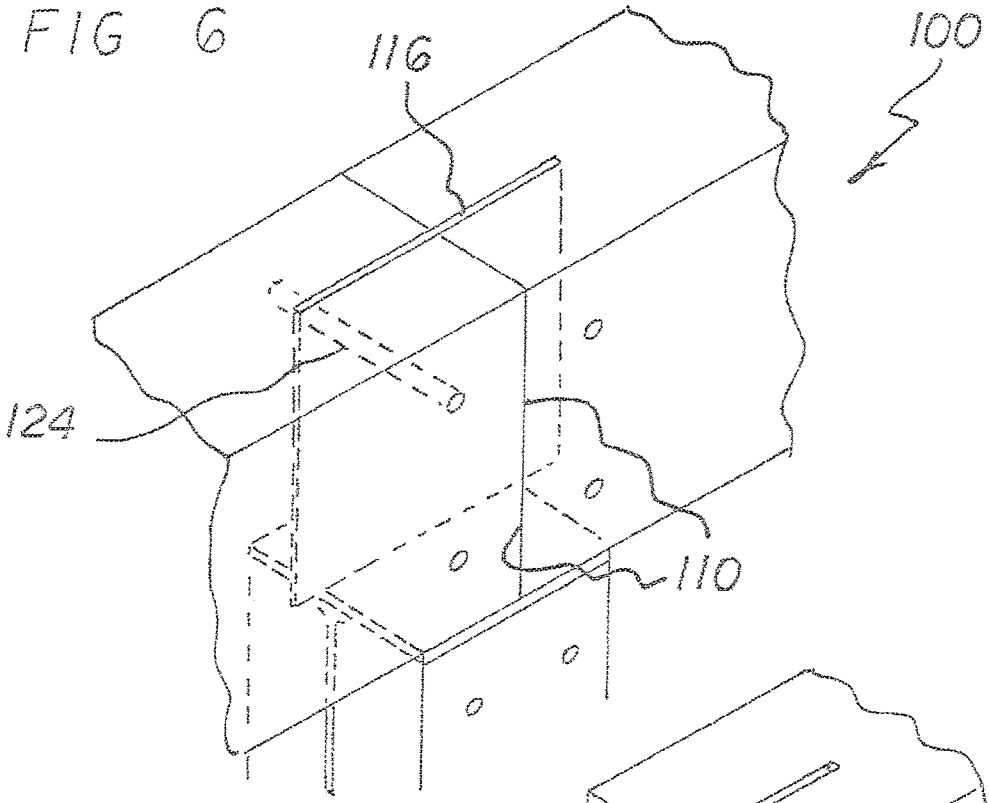
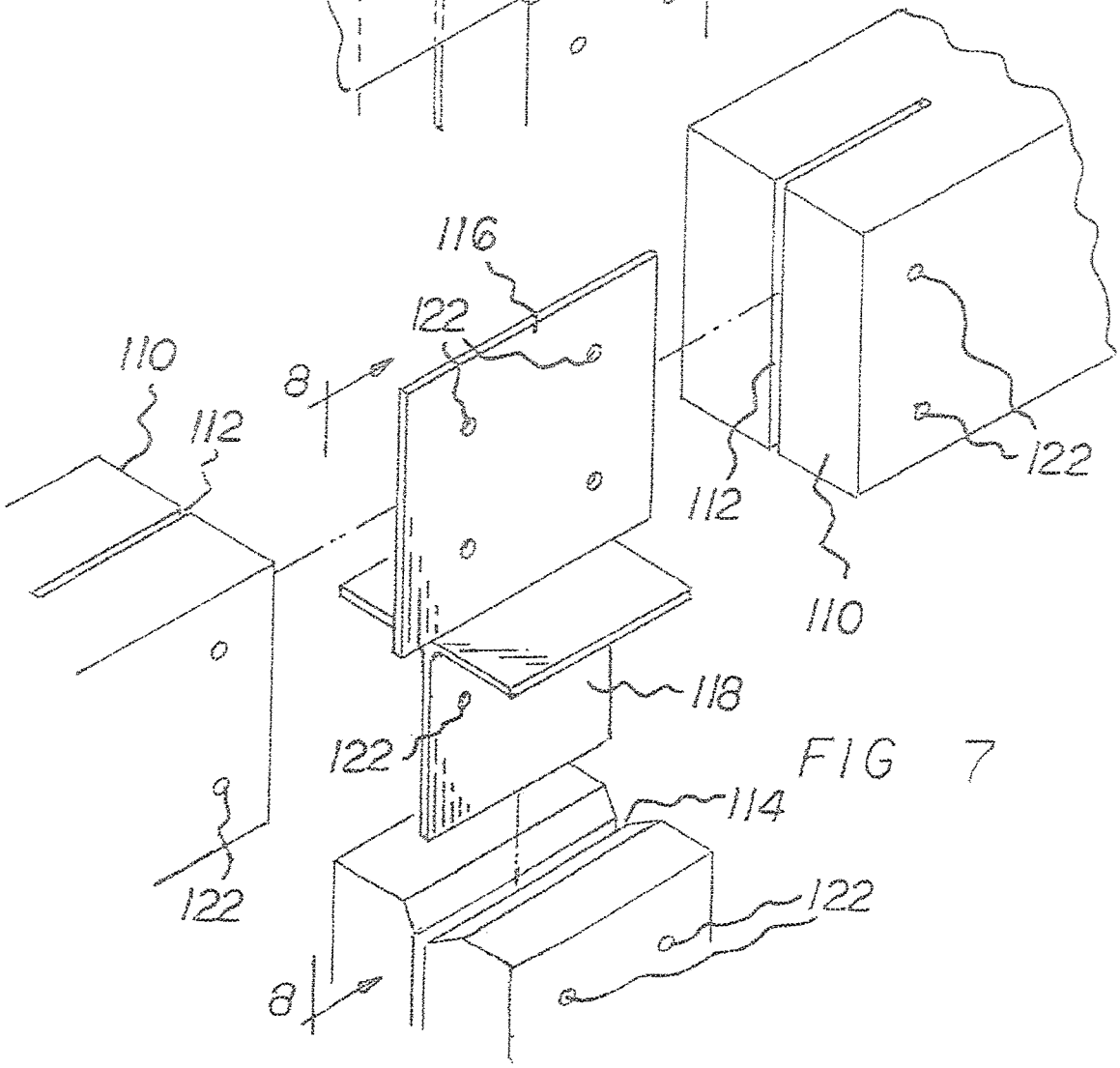
FIG 7

FIG. 7A
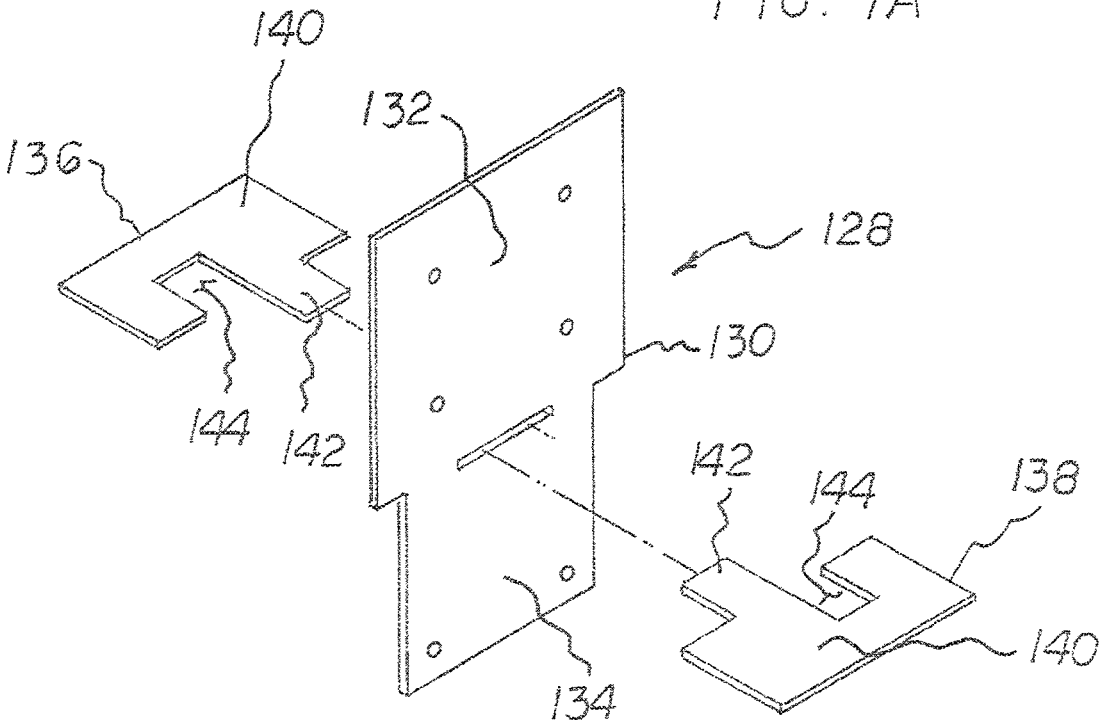
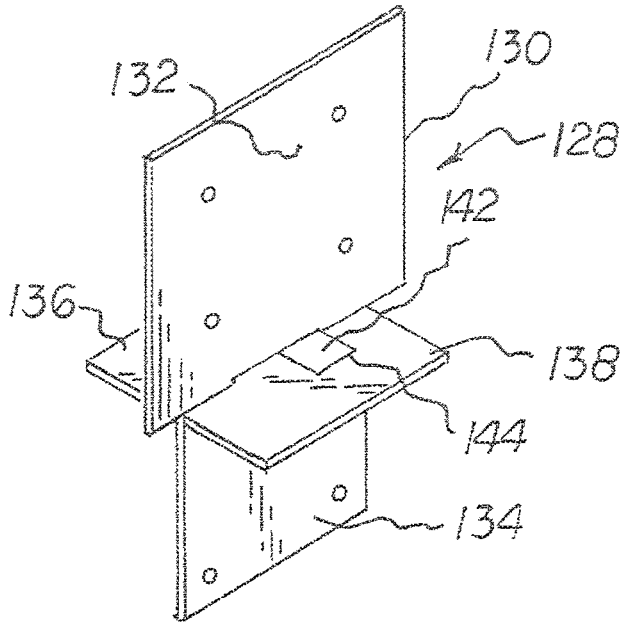
FIG 7B

FIG. 11
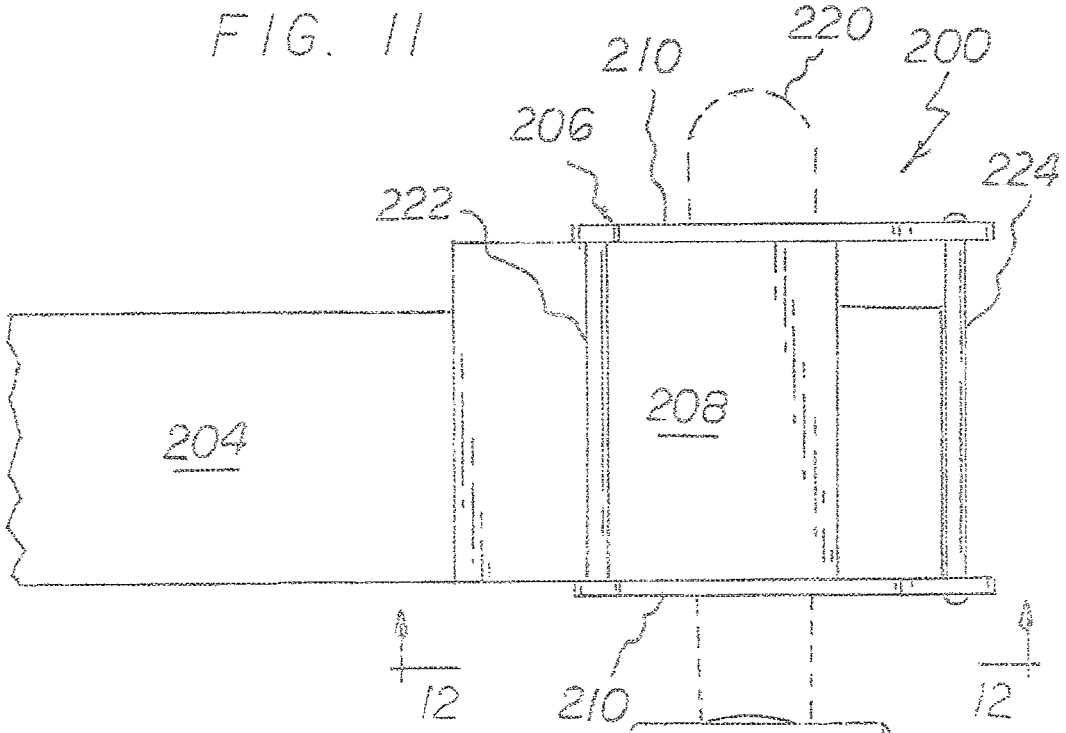
FIG. 12
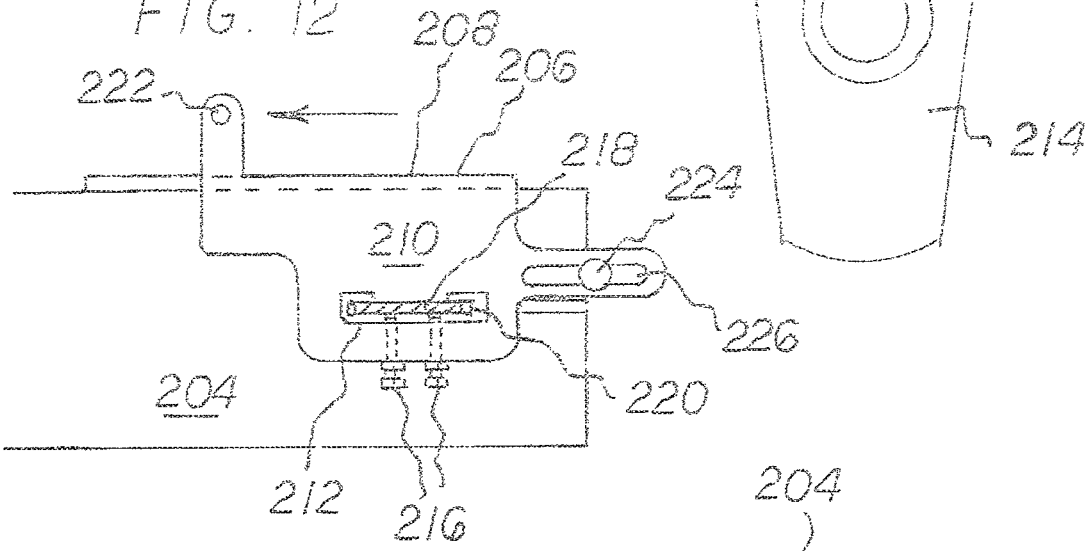
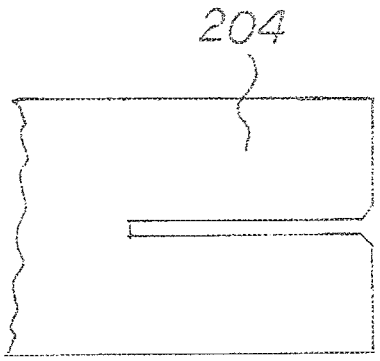
FIG 13

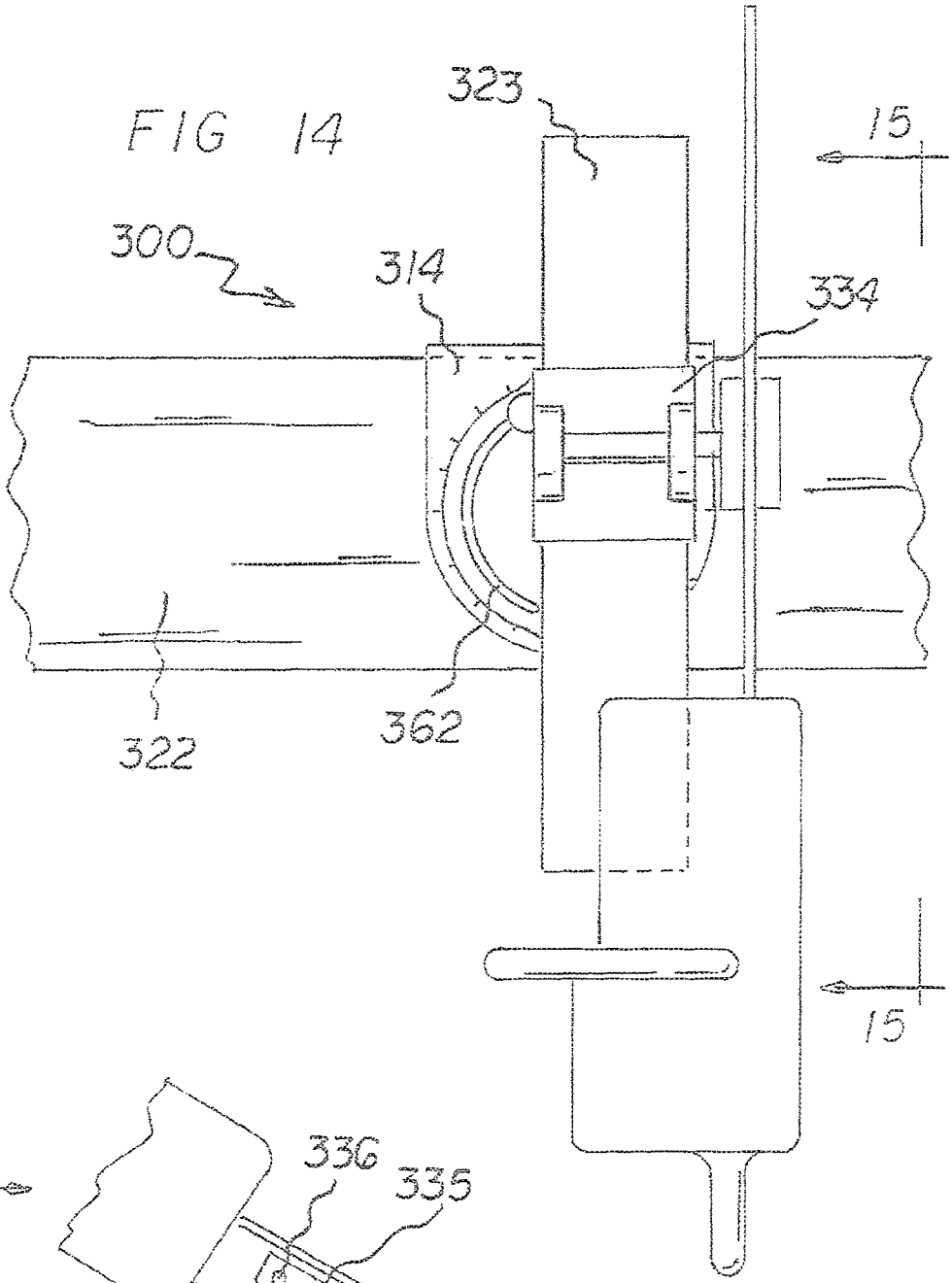
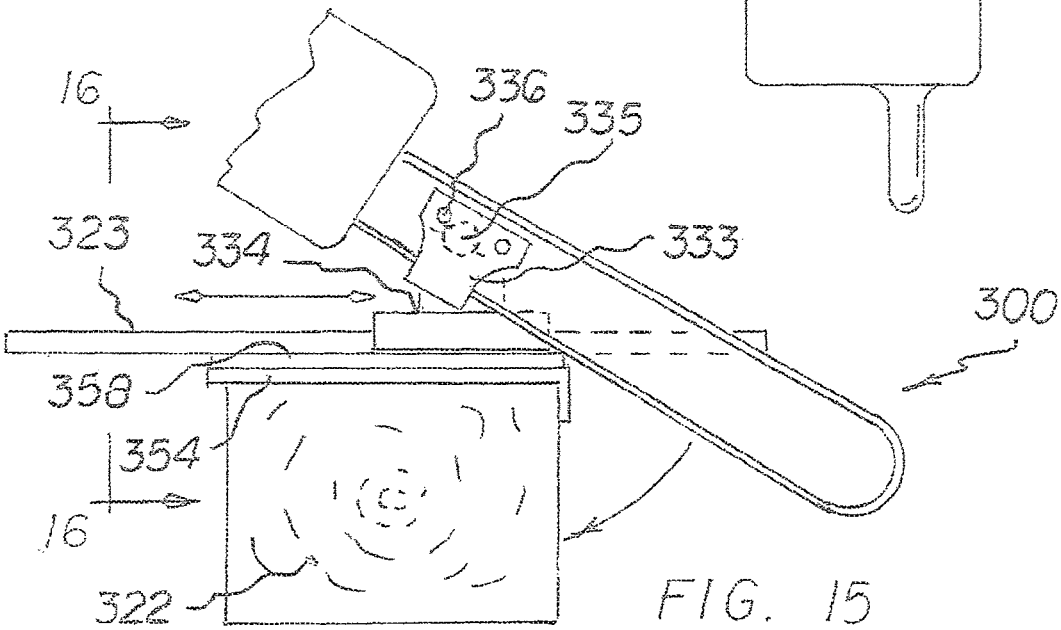
FIG. 15

FIG 18
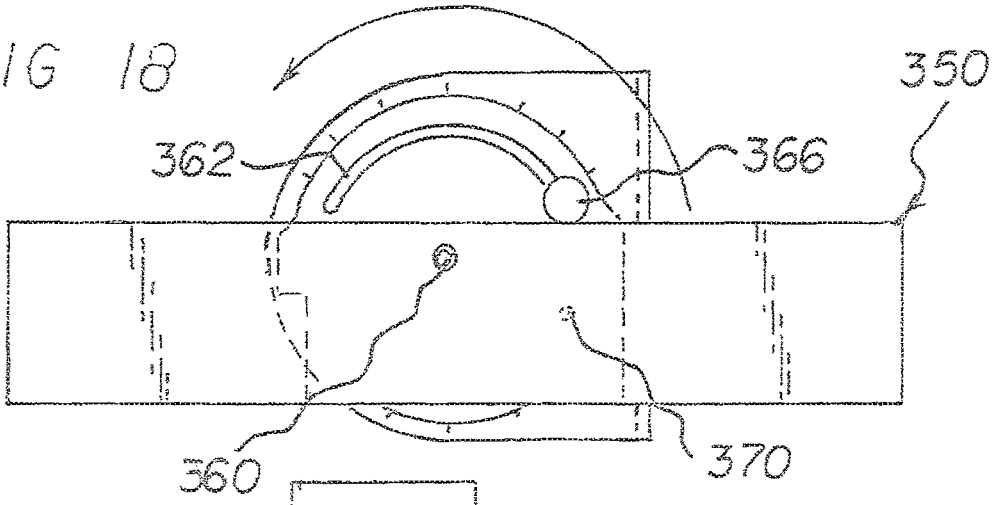
FIG. 19
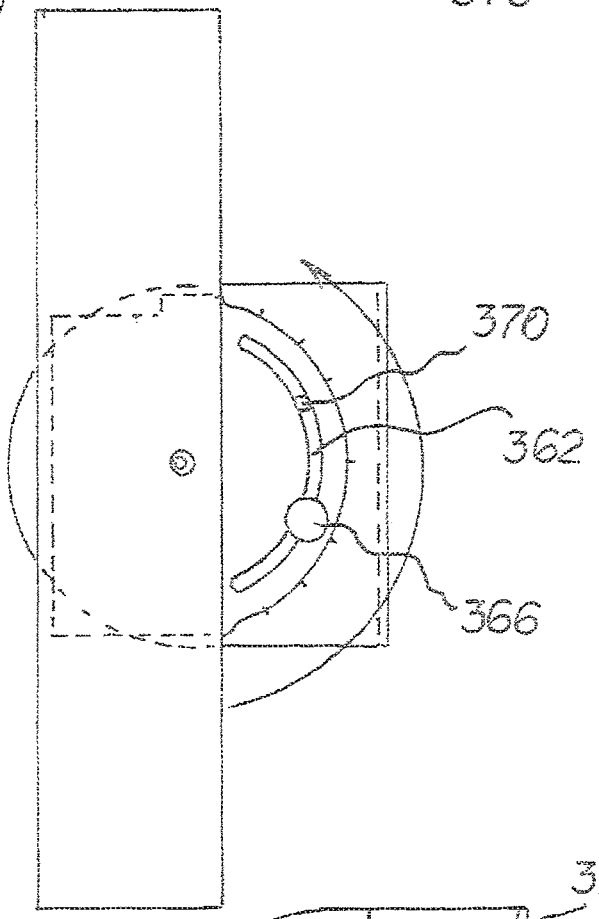
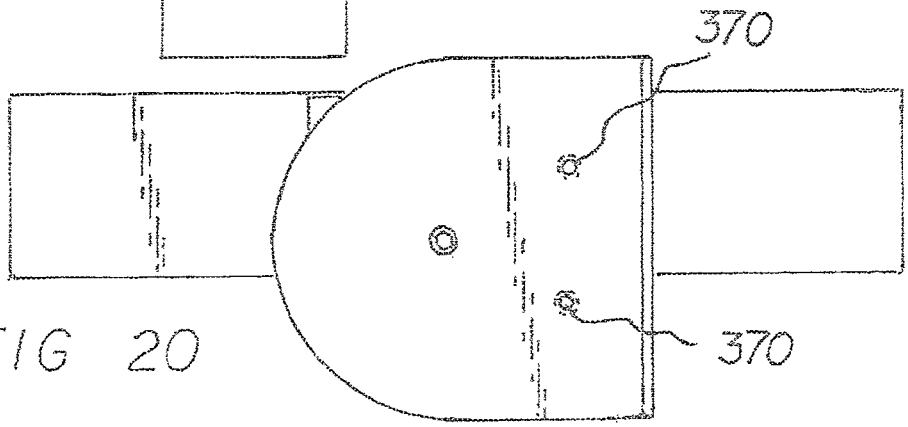
FIG 20

FIG. 21
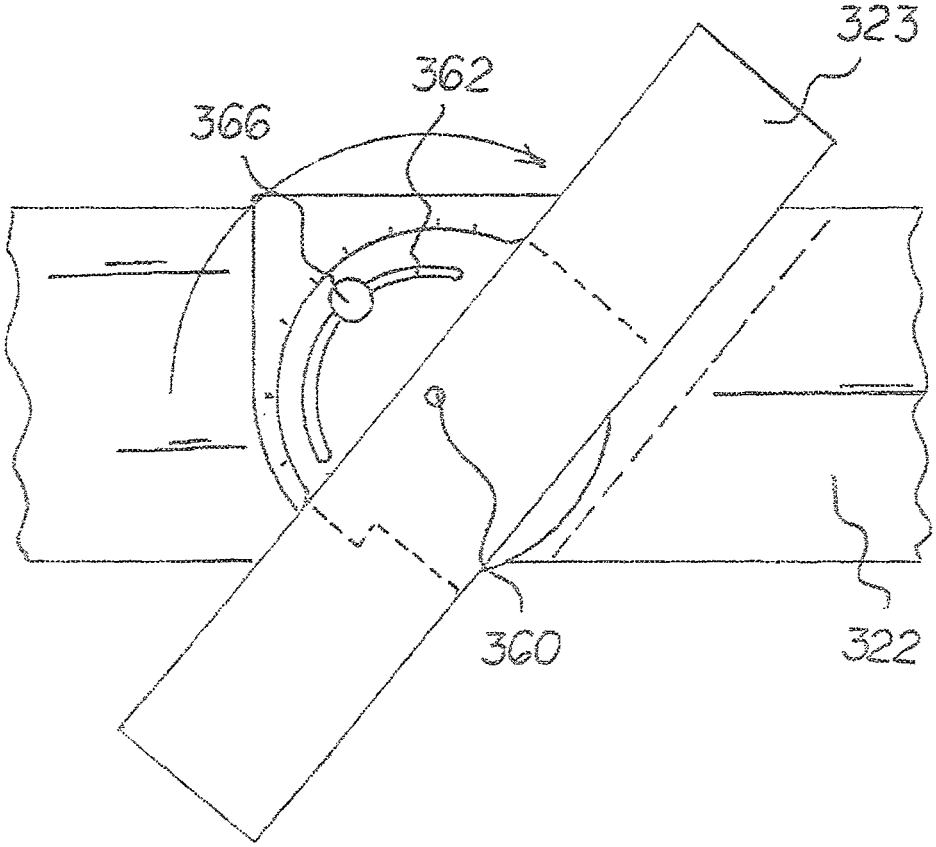
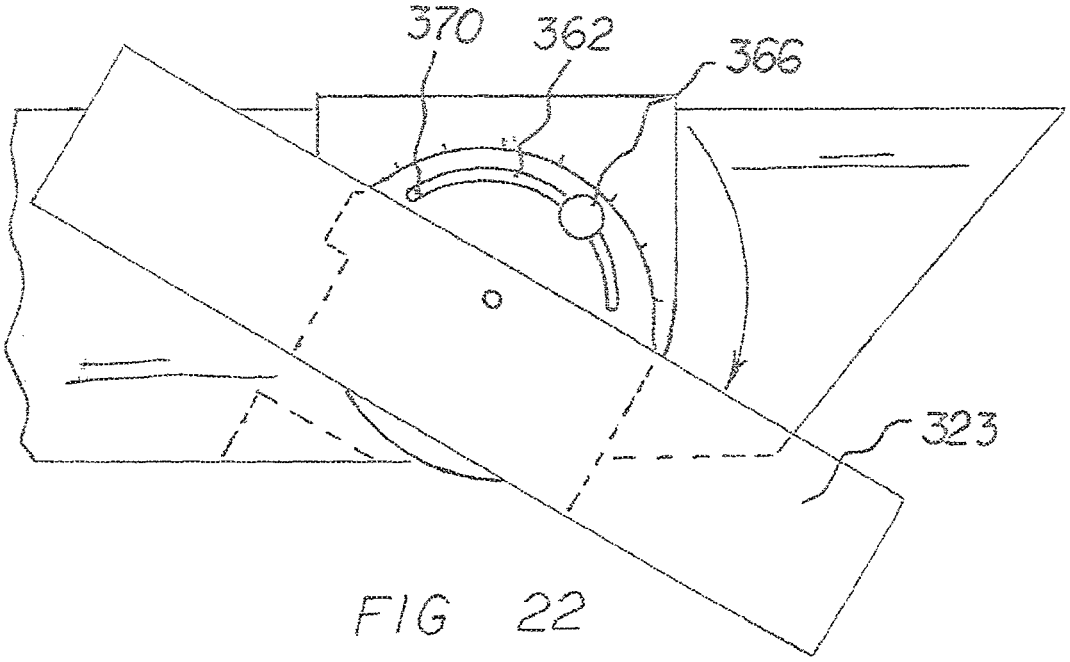
FIG 22

POST AND BEAM CUTTING DEVICE

CROSS-REFERENCE TO RELATED APPLICATIONS

The present application is a continuation-in-part of U.S. patent application Ser. No. 15/060,674, filed Mar. 4, 2016, which claims the benefit of U.S. Provisional Patent Application No. 62/130,280, filed Mar. 9, 2015, the subject matter of which are incorporated herein by reference.

BACKGROUND OF THE INVENTION

The present invention relates to a post and beam system and more particularly pertains to coupling a beam to a post and for preparing the post and the beam for coupling in a safe, rapid, accurate, eye-appealing, and economical manner.

DESCRIPTION OF THE PRIOR ART

The use of post and beam systems of known designs and configurations is known in the prior art. More specifically, post and beam systems of known designs and configurations previously devised and utilized for the purpose of constructing post and beam buildings are known to consist basically of familiar, expected, and obvious structural configurations, notwithstanding the myriad of designs encompassed by the crowded prior art which has been developed for the fulfillment of countless objectives and requirements.

While known devices fulfill their respective, particular objectives and requirements, the prior art does not describe a post and beam system that allows coupling a beam to a post and for preparing the post and the beam for coupling in a safe, rapid, accurate, eye-appealing, and economical manner.

In this respect, the post and beam system according to the present invention substantially departs from the conventional concepts and designs of the prior art, and in doing so provides an apparatus primarily developed for the purpose of coupling a beam to a post and for preparing the post and the beam for coupling in a safe, rapid, accurate, eye-appealing, and economical manner.

Therefore, it can be appreciated that there exists a continuing need for a new and improved post and beam system which can be used for coupling a beam to a post and for preparing the post and the beam for coupling in a safe, rapid, accurate, eye-appealing, and economical manner. In this regard, the present invention substantially fulfills this need.

BRIEF SUMMARY OF THE INVENTION

In view of the disadvantages inherent in the known types of post and beam constructions now present in the prior art, the present invention provides an improved post and beam system. As such, the general purpose of the present invention, which will be described subsequently in greater detail, is to provide a new and improved post and beam system and method which has all the advantages of the prior art and none of the disadvantages.

To attain this, the present invention essentially comprises a beam having an upper face, a lower face, side faces, and an end face. The end face has a rectangular configuration and is vertically disposed. The end face has a slot vertically disposed and parallel with, and equally spaced from, the side faces. Beam holes extend through the beam on opposite sides of the slot.

Next provided is a post having a front face, a parallel rear face, and parallel side faces. A connector is provided having a first section and a second section. Beam apertures are formed in the first section. The first section is positioned in the slot with the beam apertures aligned with the beam holes. The second section is attached to the post. Lastly, dowels are provided extending through the beam holes and the beam apertures thereby coupling the beam to the post.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved post and beam system which has all of the advantages of the prior art post and beam constructions and none of the disadvantages.

It is another object of the present invention to provide a new and improved post and beam system which may be easily and efficiently manufactured and marketed.

It is further object of the present invention to provide a new and improved post and beam system which is of durable and reliable constructions.

An even further object of the present invention is to provide a new and improved post and beam system which is susceptible of a low cost of manufacture with regard to both materials and labor, and which accordingly is then susceptible of low prices of sale, thereby making such post and beam system economically available.

Lastly, it is an object of the present invention to provide a new and improved post and beam system which can be used for coupling a beam to a post and for preparing the post and the beam for coupling in a safe, rapid, accurate, eye-appealing, and economical manner. In this regard, the present invention substantially fulfills this need.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE SEVERAL VIEWS OF THE DRAWING(S)

The invention will be better understood and objects other than those set forth above will become apparent when consideration is given to the following detailed description thereof. Such description makes reference to the annexed drawings wherein:

FIG. 3 is a front elevational view of the connector taken along line 3-3 of FIG. 2.

FIG. 4 is a side elevational view of the connector taken along line 4-4 of FIG. 3.

FIG. 5 is a plan view of the connector taken along line 5-5 of FIG. 3.

FIG. 6 is a perspective illustration of an alternate embodiment of the invention.

FIG. 7 an exploded perspective illustration of the alternate embodiment of the invention shown in FIG. 6.

FIG. 7A is an exploded perspective illustration of a connector constructed in an alternate design.

FIG. 7B is a perspective illustration of the connector illustrated in FIG. 7A.

Figure 8:
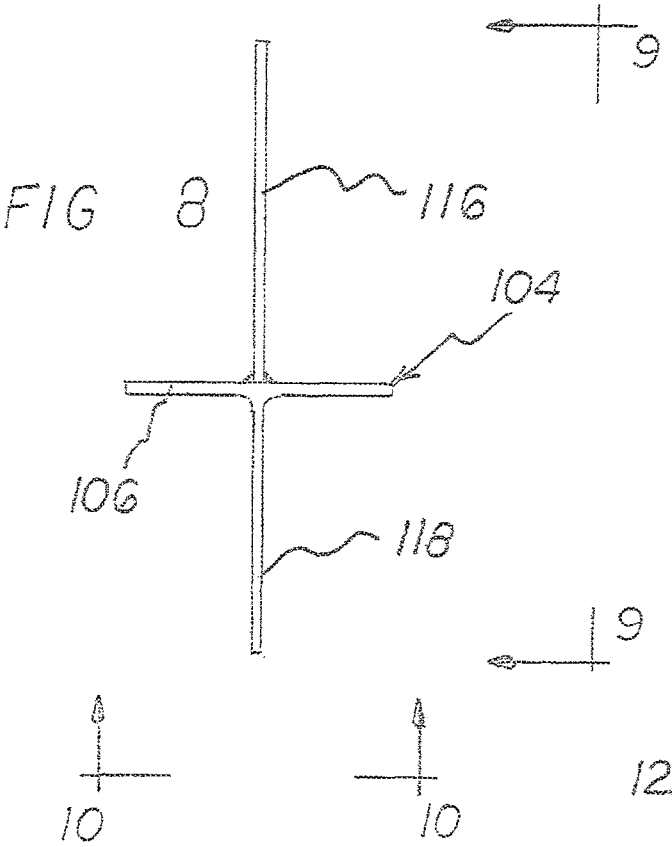

FIG. 8 is a front elevational view of the connector taken along line 8-8 of FIG. 7.

Figure 9:
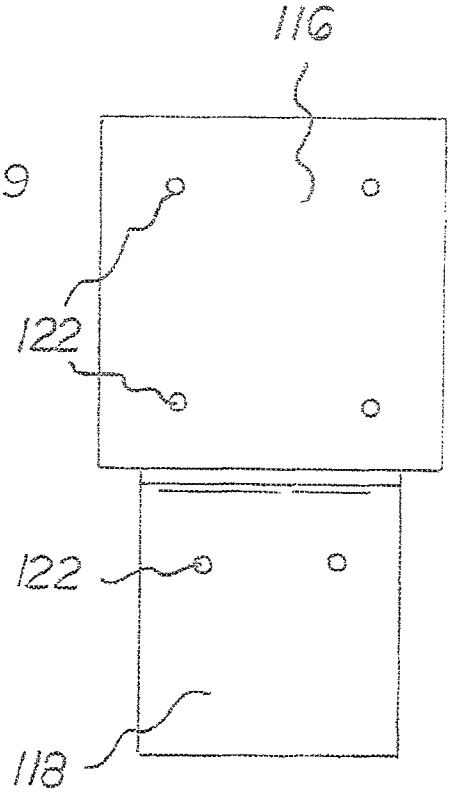

FIG. 9 is a side elevational view of the connector taken along line 9-9 of FIG. 8.

Figure 10:
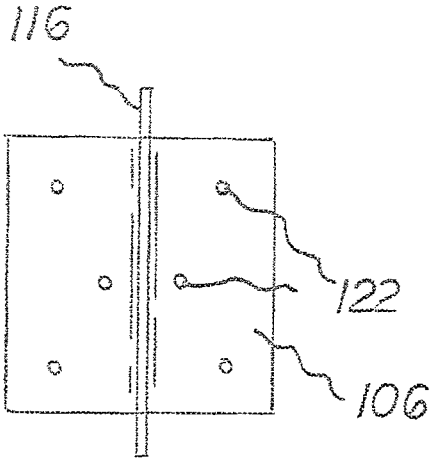

FIG. 10 is a bottom view of the connector taken along line 10-10 of FIG. 8.

FIG. 11 is a plan view of a slotting device constructed in accordance with the principles of the present invention.

FIG. 12 is a front elevational view taken along line 12-12 of FIG. 11.

Figure 12A:
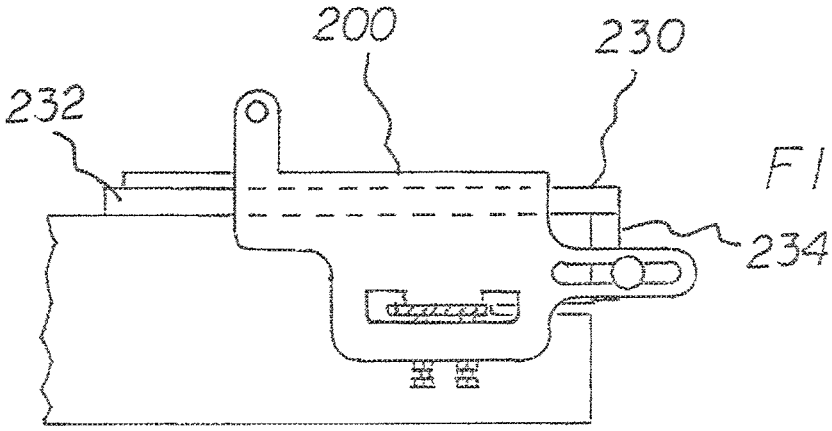

FIG. 12A is a side elevational view of a slotting device with an adapter for use with smaller workpieces.

Figure 12B:
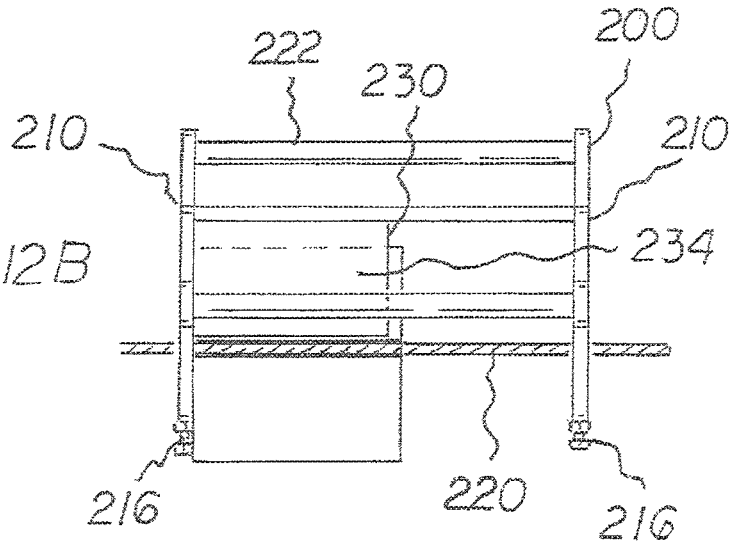

FIG. 12B is a front elevational view of the slotting device and adapter of FIG. 12A.

Figure 12C:
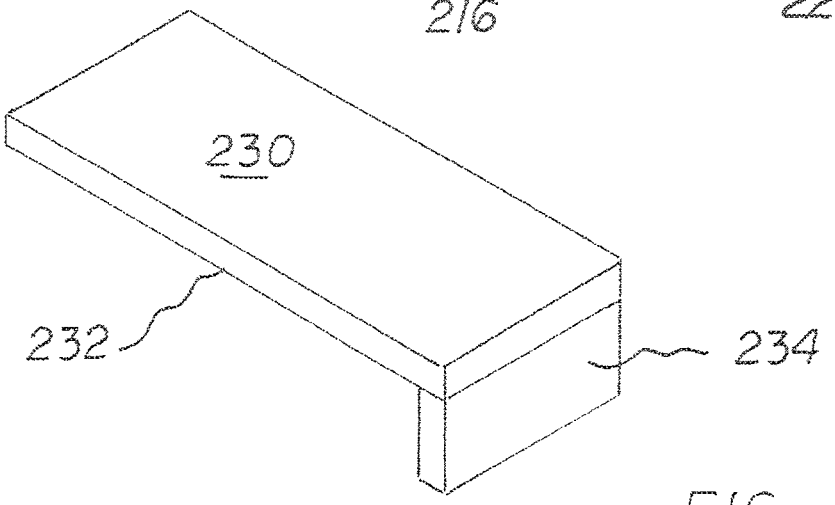

FIG. 12C is a perspective view of the adapter without the slotting device and workpiece of FIGS. 12A and 12B.

Figure 2:
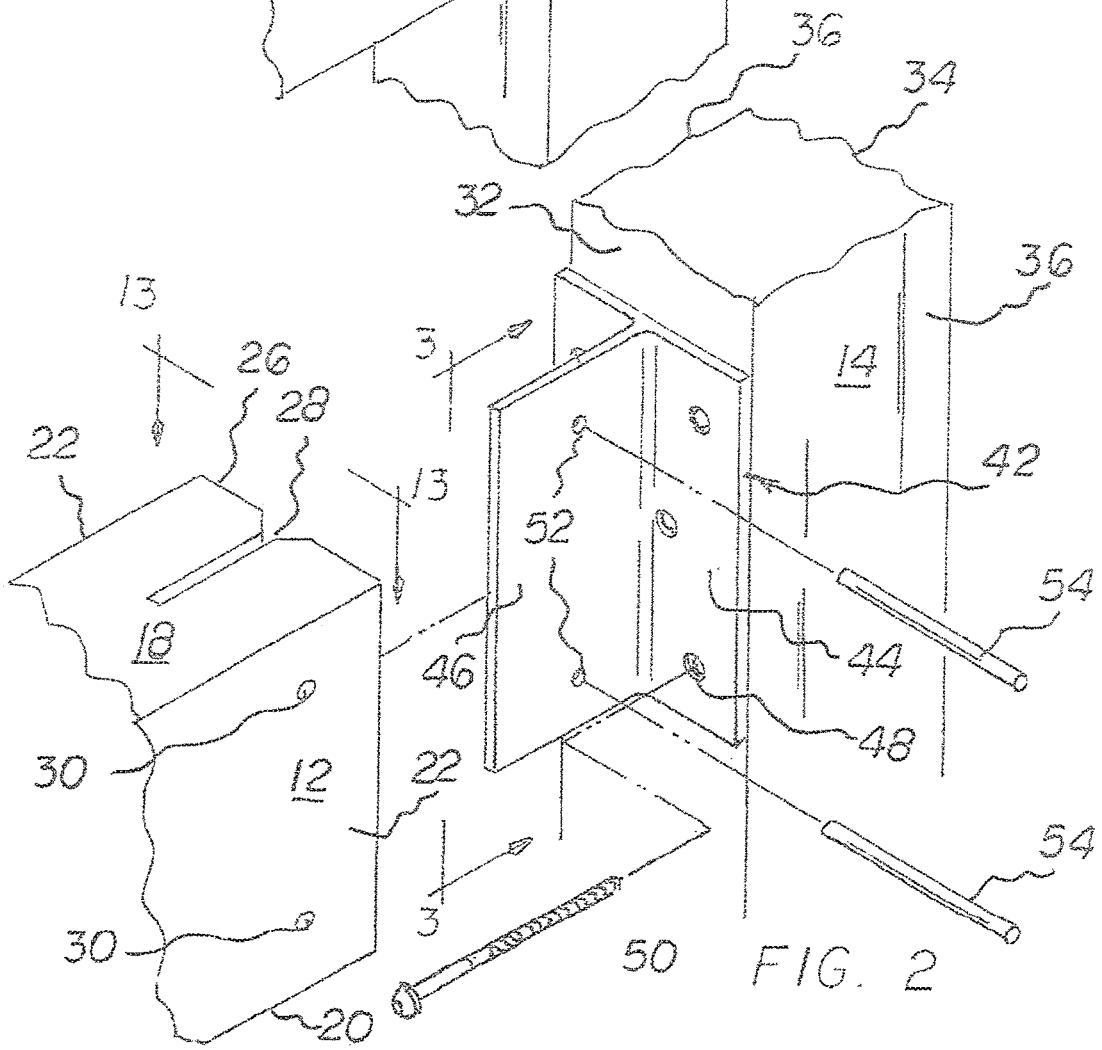
FIG. 2 is an exploded perspective illustration of the system shown in FIG. 1.

FIG. 13 is a front elevational view taken along line 13-13 of FIG. 2.

FIG. 14 is a plan view of another slotting device constructed in accordance with the principles of the present invention.

FIG. 15 is a front elevational view taken along line 15-15 of FIG. 14.

Figure 16:
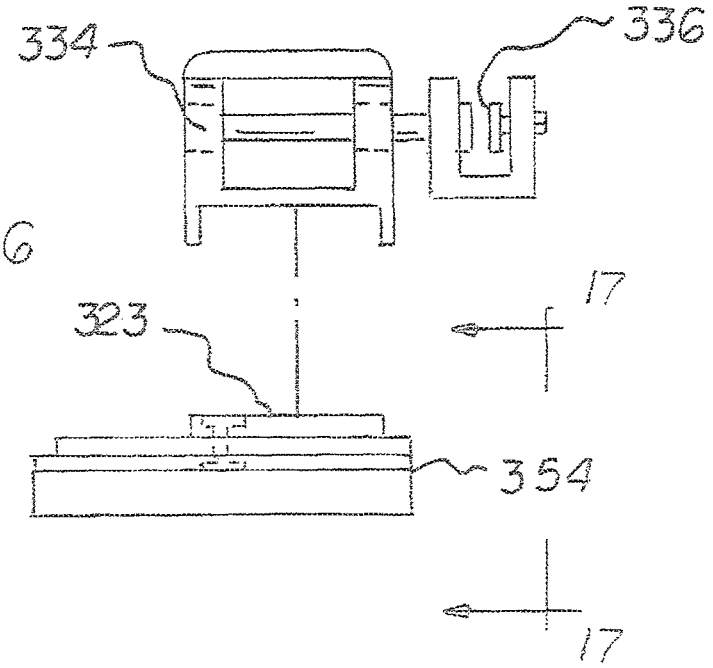

FIG. 16 is a side elevational view taken along line 16-16 of FIG. 15.

Figure 17:
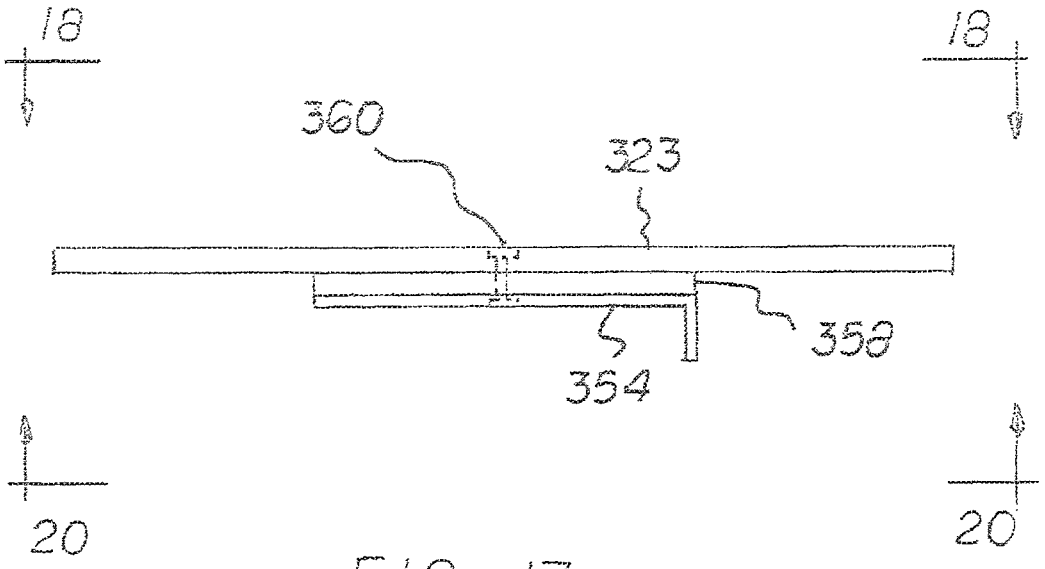

FIG. 17 is an exploded side elevational view taken along line 17-17 of FIG. 16.

FIG. 18 is a plan view taken along line 18-18 of FIG. 17.

FIG. 19 is a plan view similar to FIG. 18 but with the device rotated for an angled cut.

FIG. 20 is a bottom view taken along line 20-20 of FIG. 17.

FIG. 21 is a plan view similar to FIG. 18 but with the device rotated for an angled cut.

FIG. 22 is a plan view similar to FIG. 21 but with the device rotated for a notch cut.

Figure 23:
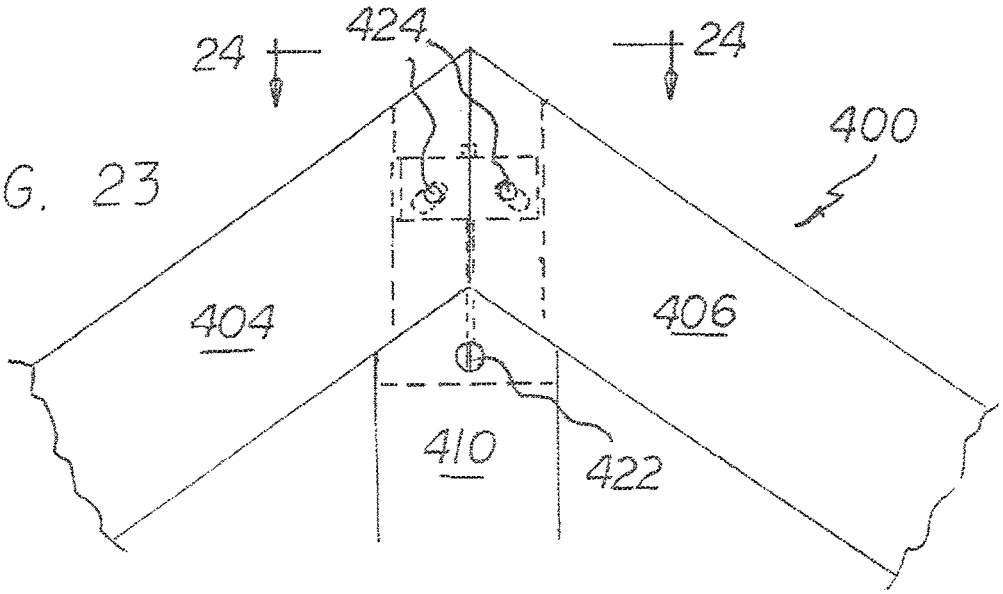

FIG. 23 is a front elevational view of an alternate embodiment for a roof constructions.

Figure 24:
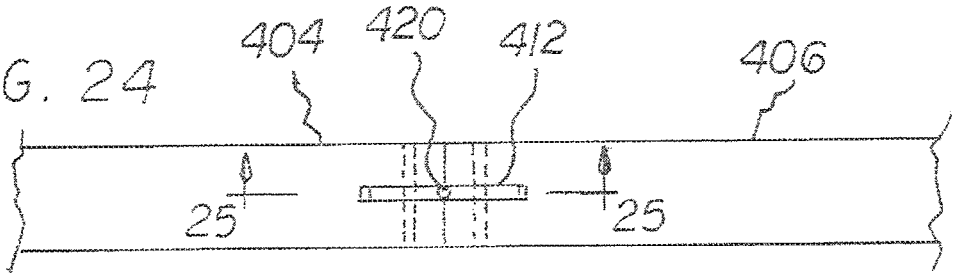

FIG. 24 is a plan view taken along line 24-24 of FIG. 23.

Figure 25:
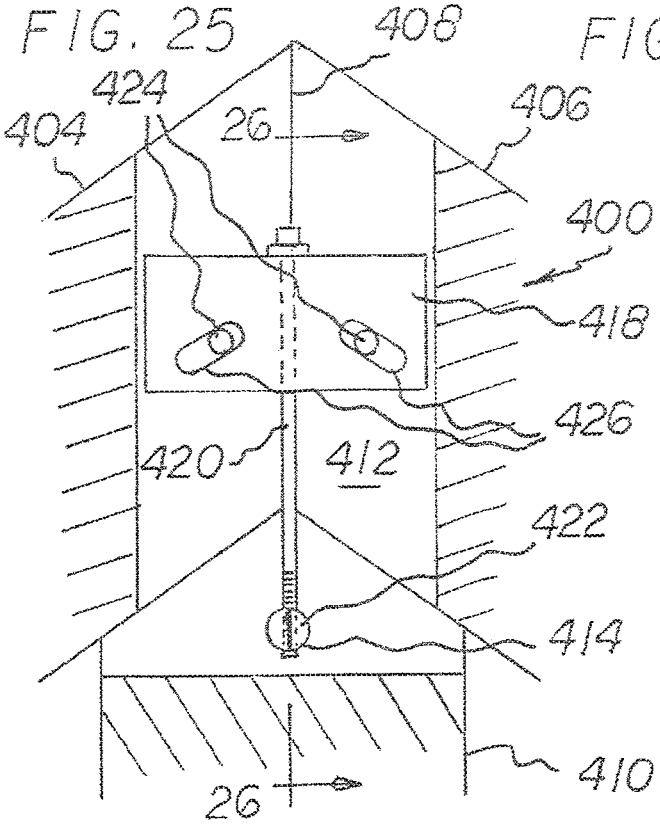

FIG. 25 is a cross sectional view taken along line 25-25 of FIG. 24.

Figure 26:
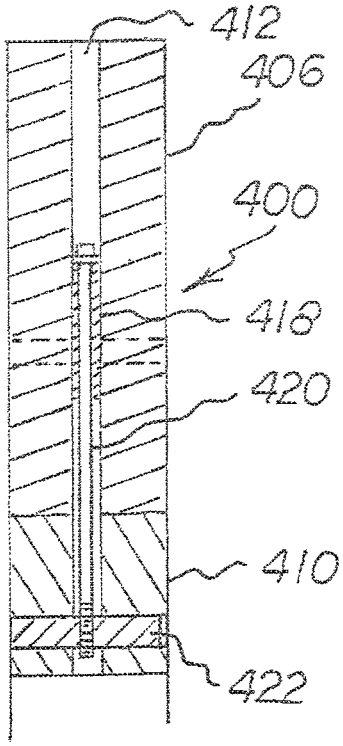

FIG. 26 is a cross sectional view taken along line 26-26 of FIG. 25.

Figure 27:
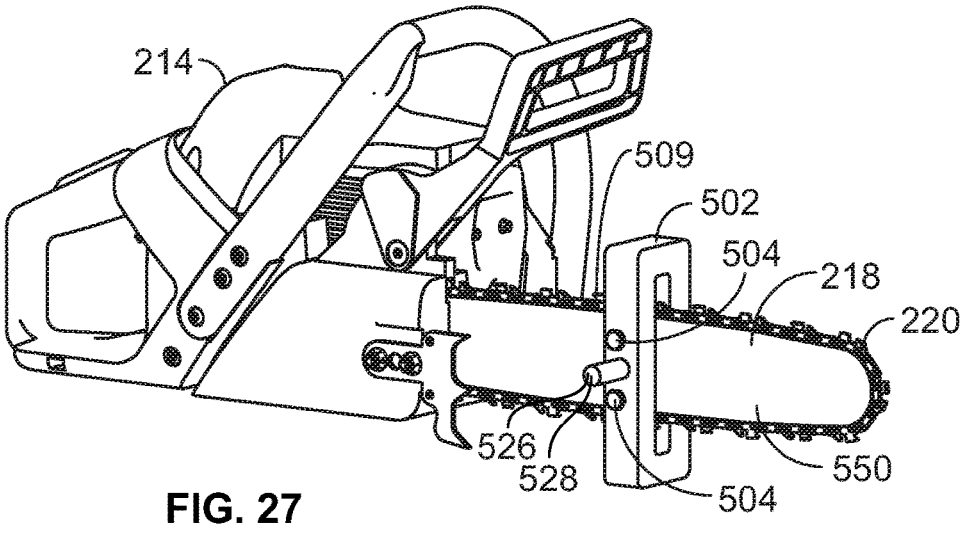

FIG. 27 is a perspective view of a chain saw with an adjustable bar clamp.

Figure 28:
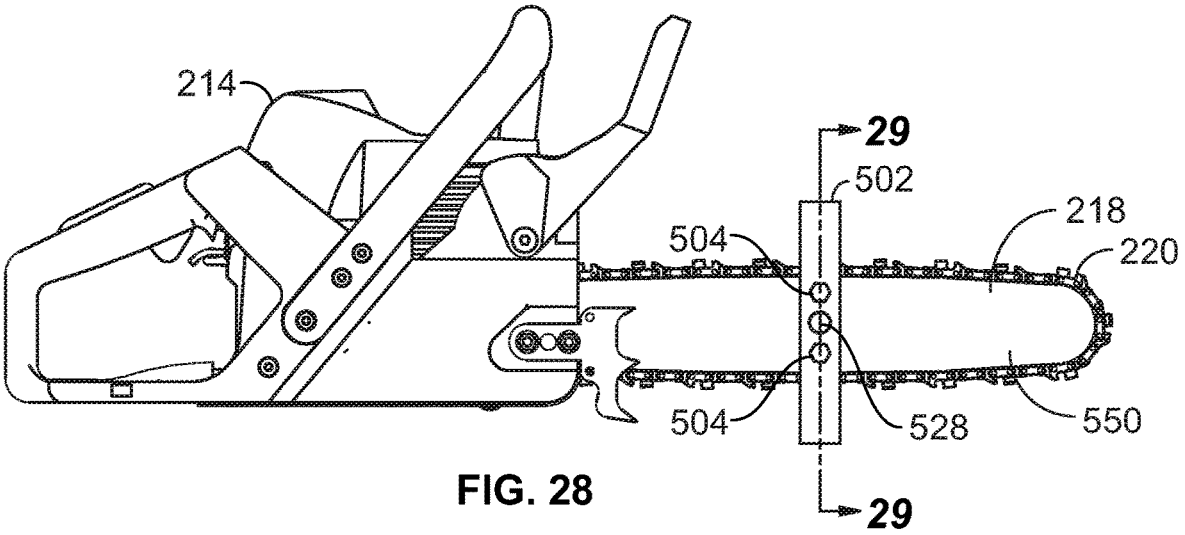

FIG. 28 is a side elevational view of a chain saw with an adjustable bar clamp.

Figure 29:
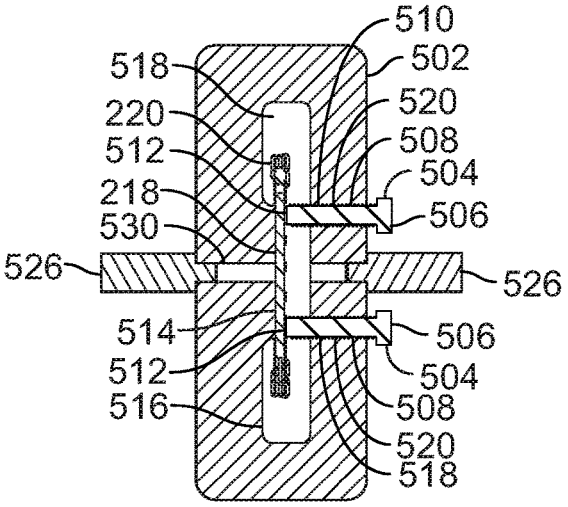

FIG. 29 is a sectional view taken along lines 29-29 of FIG. 28.

Figure 30:
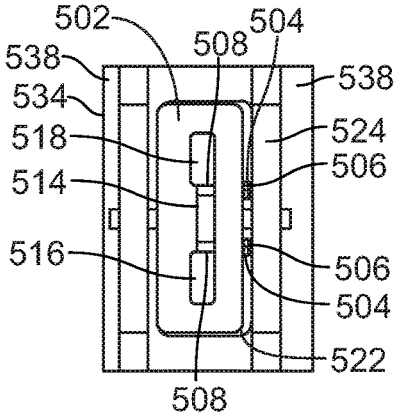

FIG. 30 is a detail of the adjustable bar clamp and slider.

Figure 31:
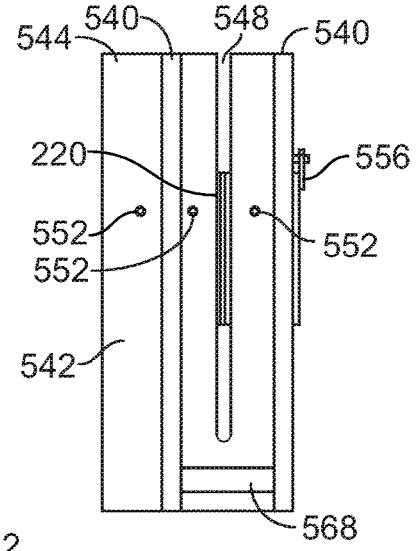

FIG. 31 is an elevational view of the vertical mounting plate.

Figure 32:
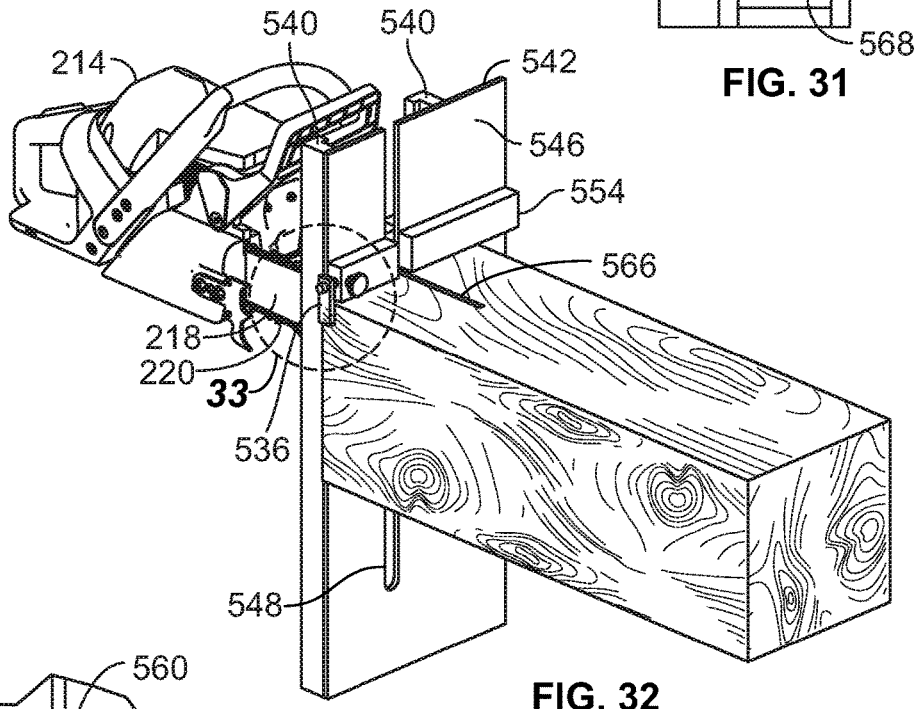

FIG. 32 is a perspective view of the combination slotting cutting device.

Figure 33:
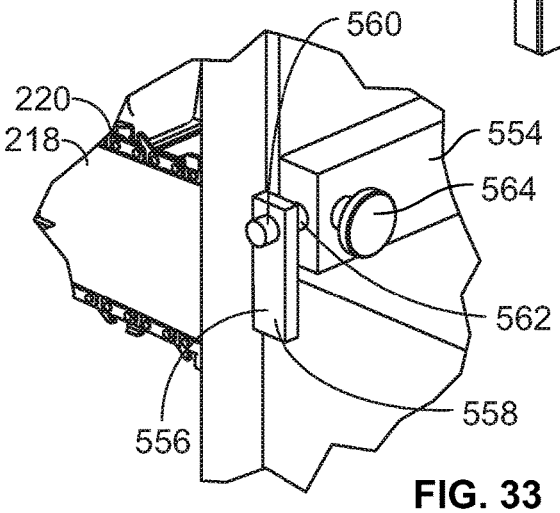

FIG. 33 is a detail of the circled area of FIG. 32.

Figure 34:
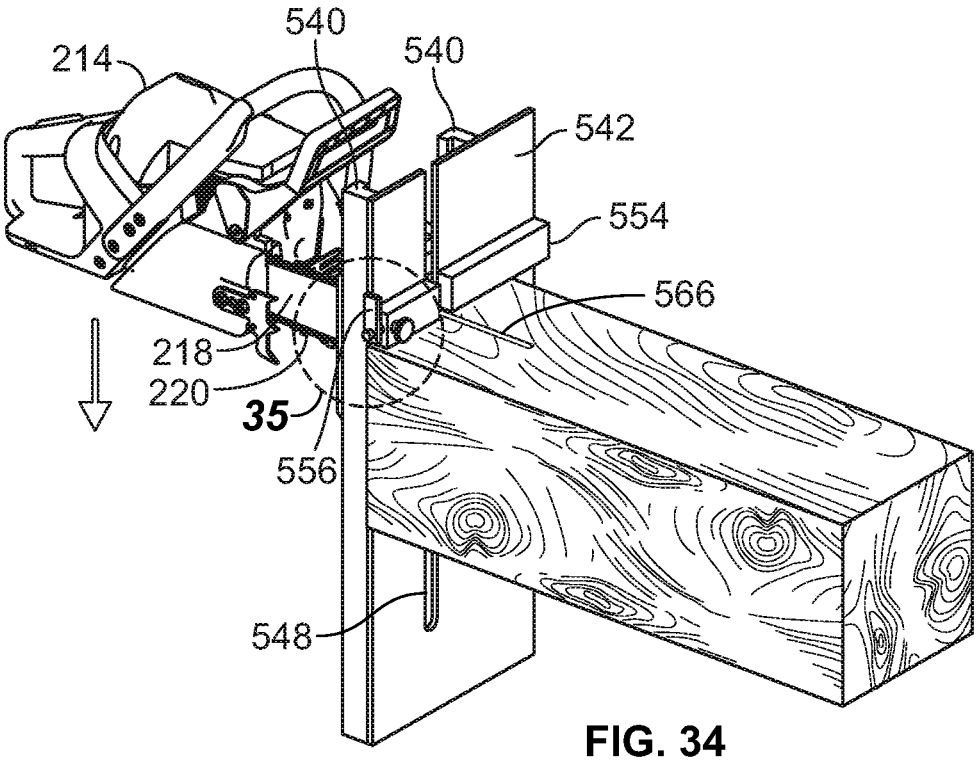

FIG. 34 is a perspective view of the combination slotting cutting device.

Figure 35:
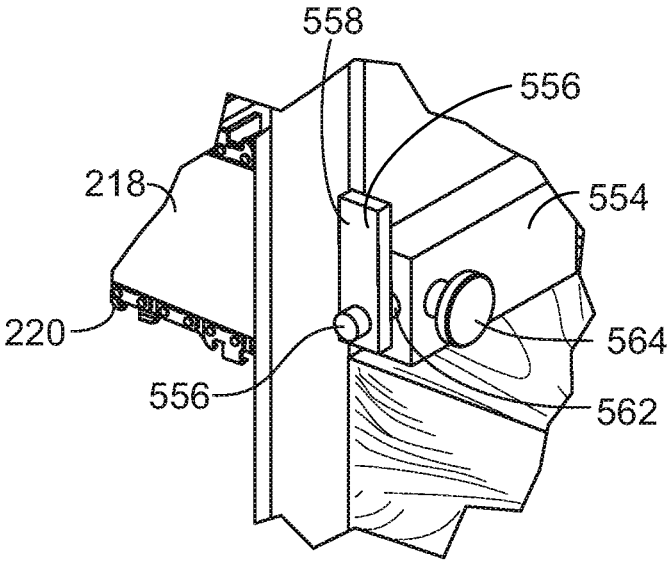

FIG. 35 is a detail of the circled area of FIG. 34.

Figure 36:
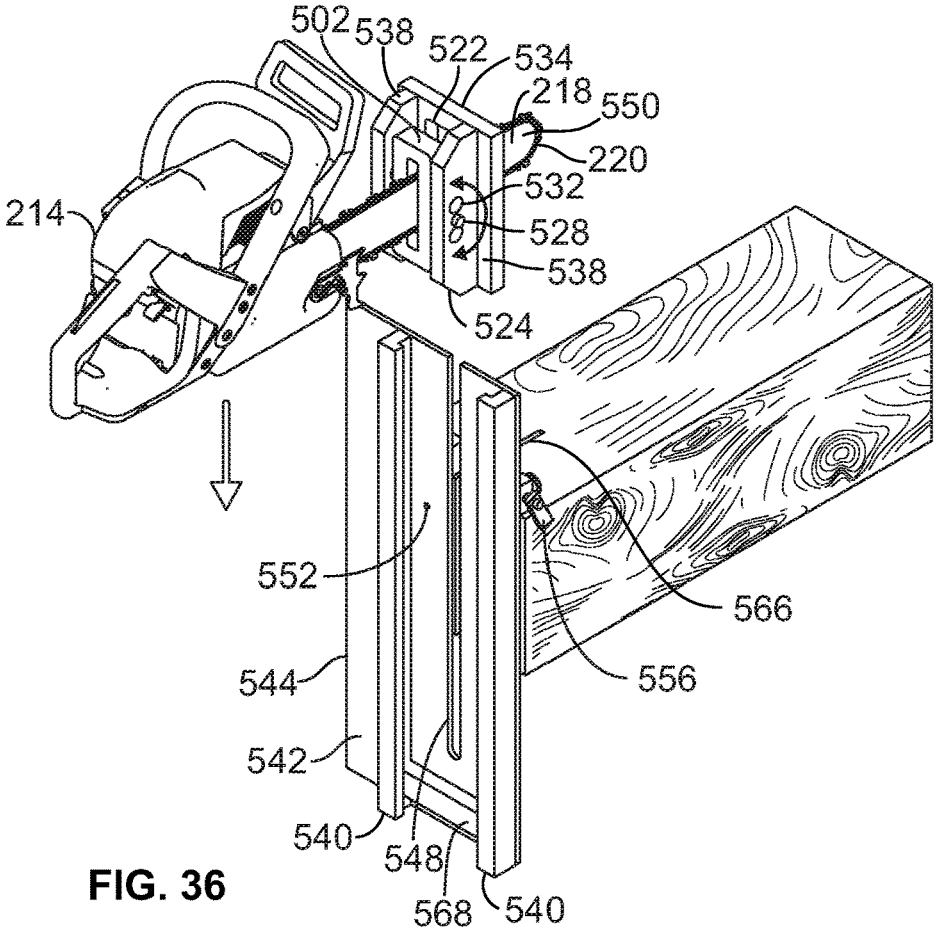

FIG. 36 is a rear perspective view of the combination slotting cutting device.

Figure 37:
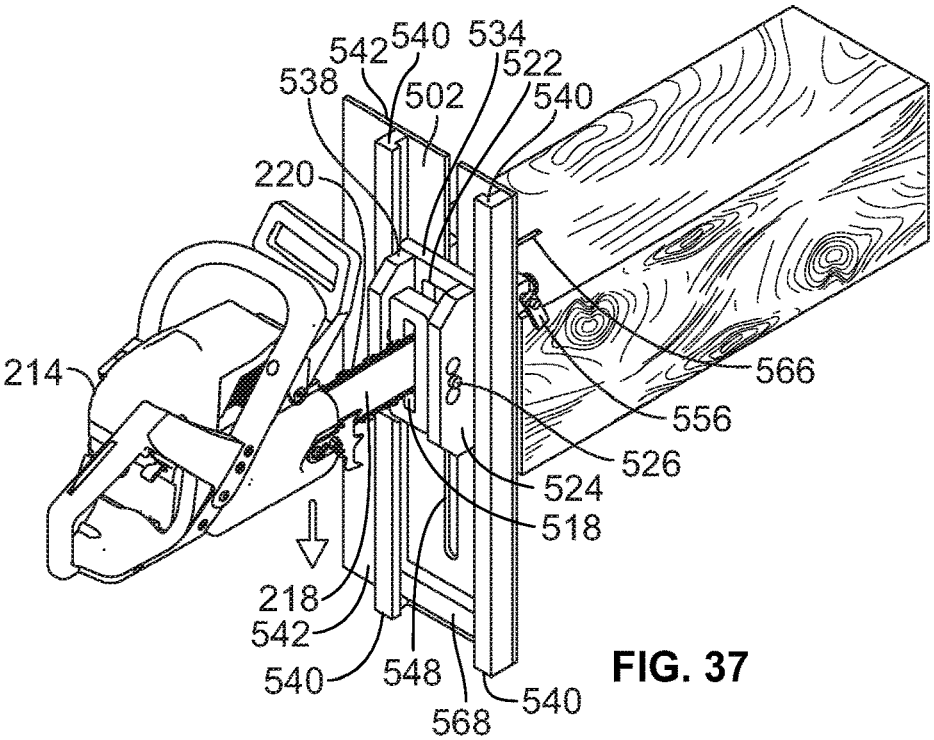

FIG. 37 is a rear perspective view of the combination slotting cutting device.

Figure 38:
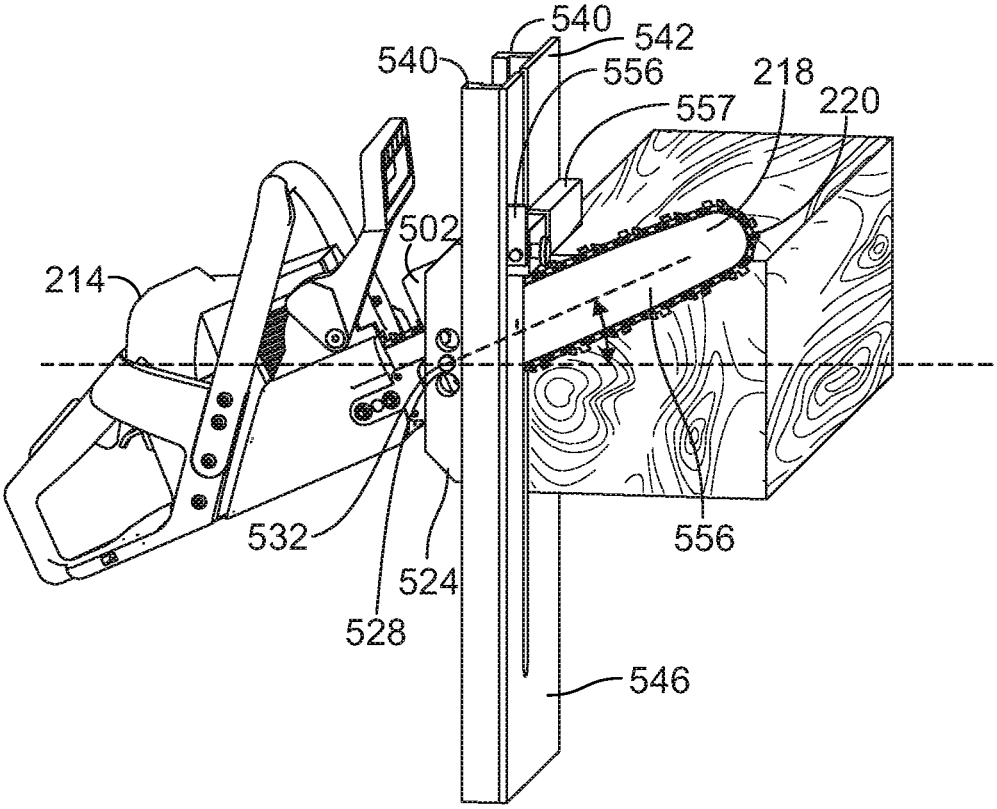

FIG. 38 is a side perspective view of the combination slotting cutting device.

Figure 39:
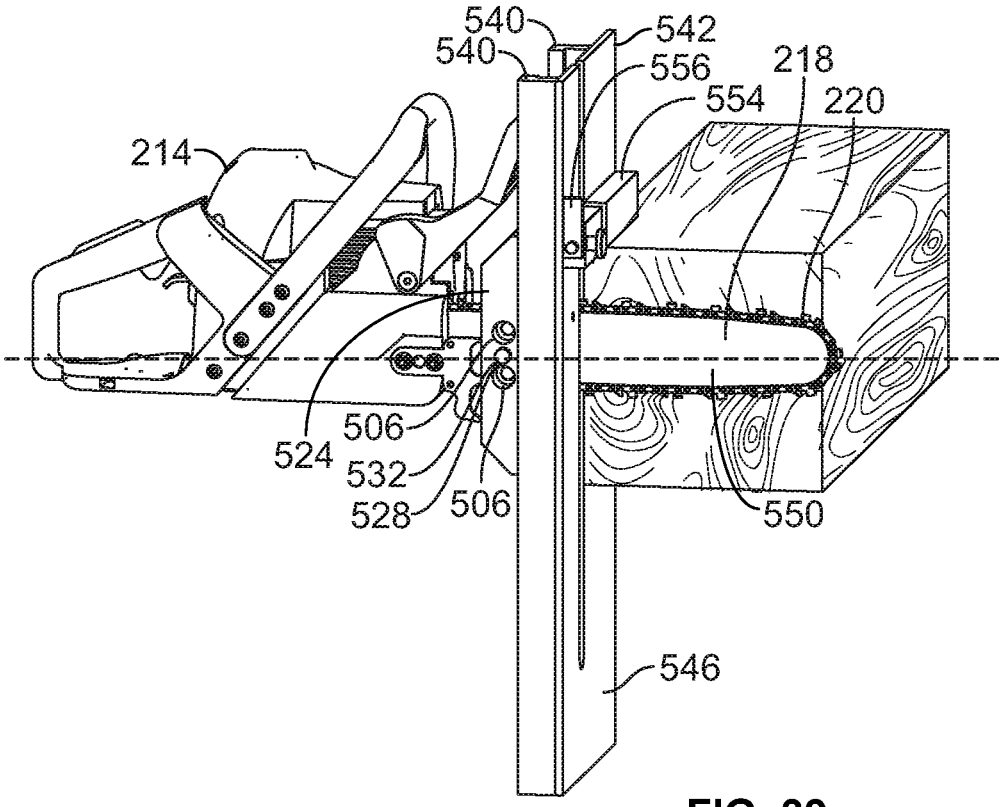

FIG. 39 is a side perspective view of the combination slotting cutting device.

Figure 40:
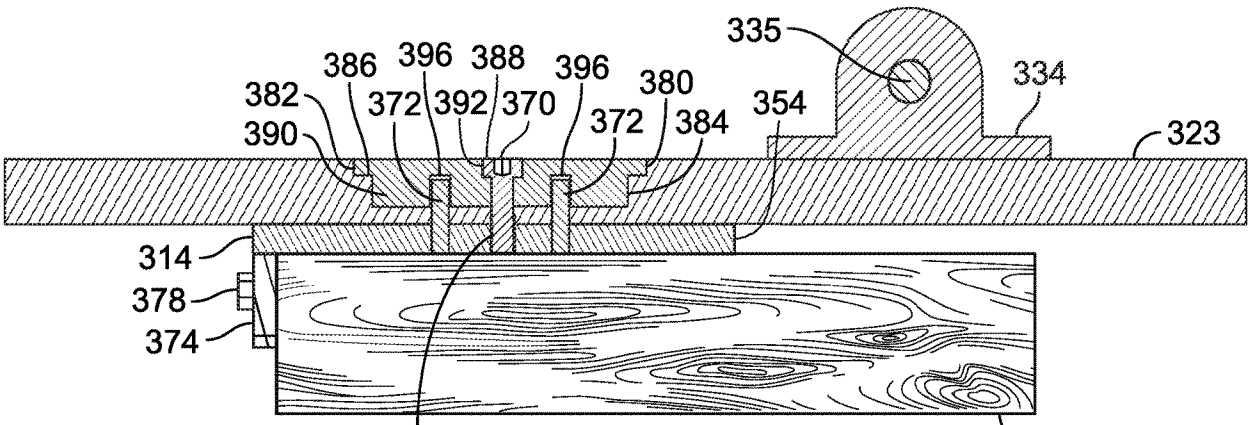
Figure 41:
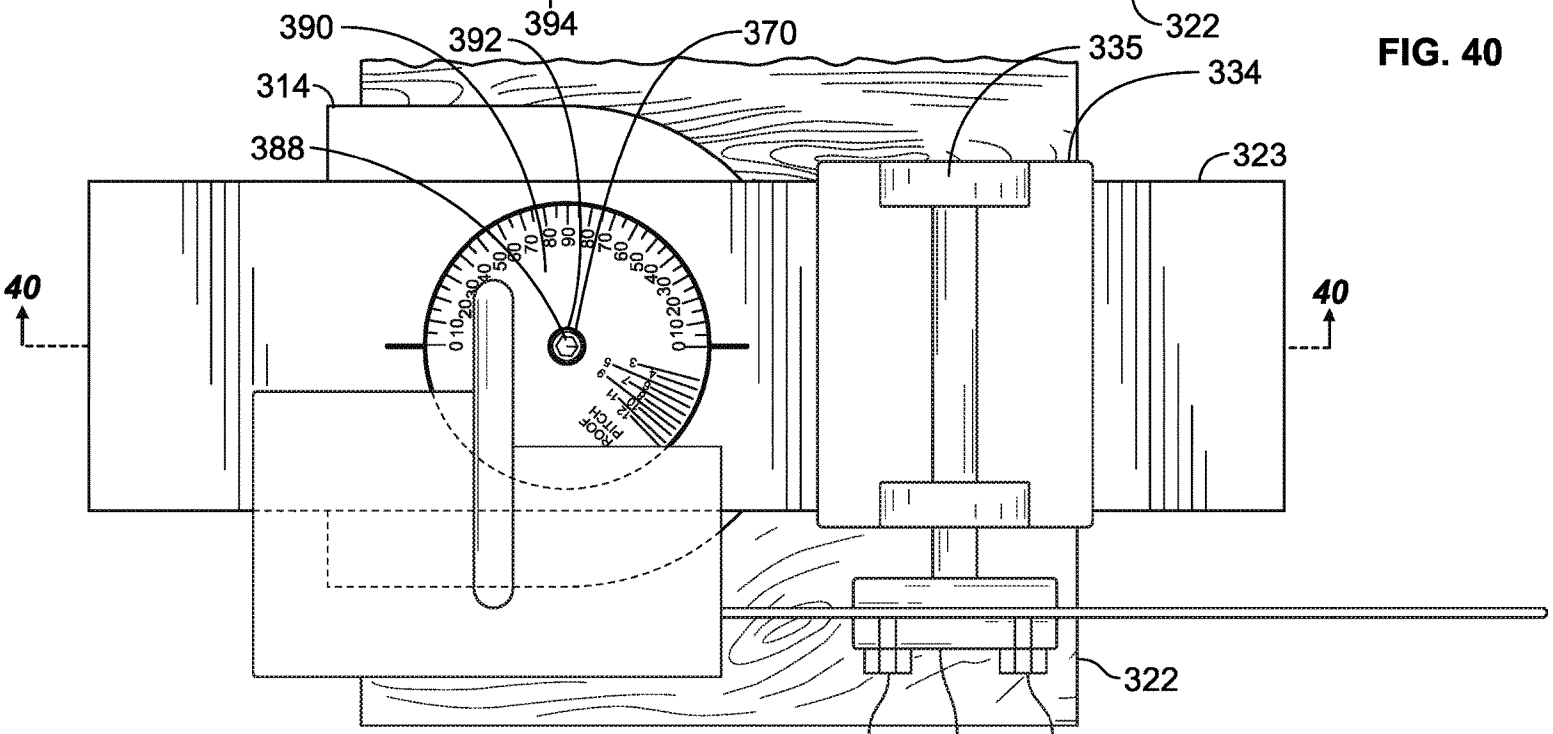

FIG. 40 is a cross sectional view of a portion of the improved rotary table taken along line 40-40 of FIG. 41.

FIG. 41 is a top plan view of a portion of the improved rotary table.

Figure 42:
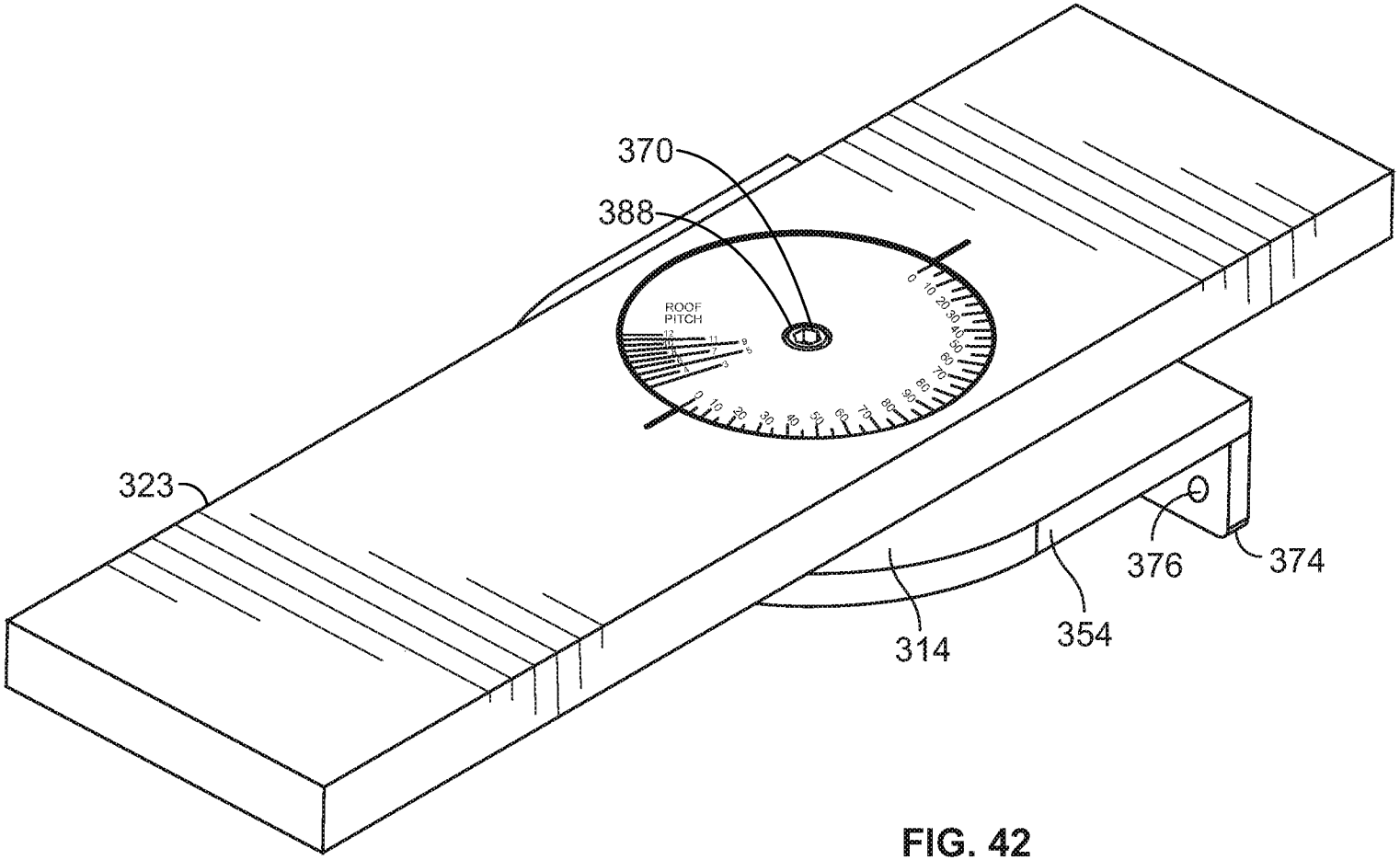

FIG. 42 is a perspective view of a portion of the improved rotary table.

The same reference numerals refer to the same parts throughout the various Figures.

DETAILED DESCRIPTION OF THE INVENTION

Figure 1:
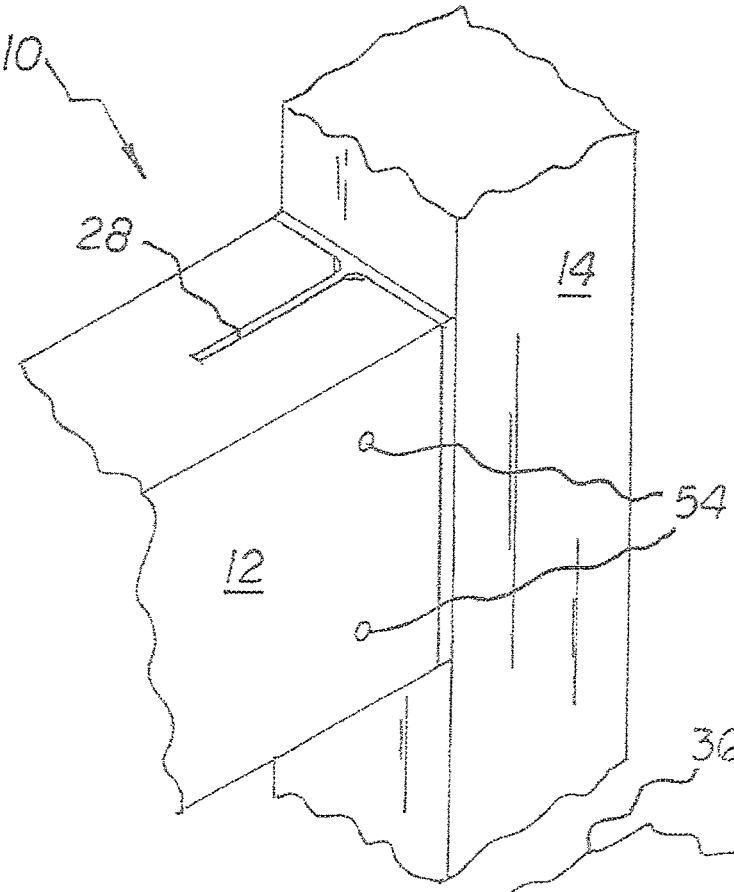
FIG. 1 is a perspective illustration of a post and beam system constructed in accordance with the principles of the present invention.

With reference now to the drawings, and in particular to FIG. 1 thereof, the preferred embodiment of the new and improved post and beam system embodying the principles and concepts of the present invention and generally designated by the reference numeral 10 will be described.

The present invention, the post and beam system 10 is comprised of a plurality of components. Such components are individually configured and correlated with respect to each other so as to attain the desired objective. In their broadest context such include a beam, a post, a connector and dowels. In this broad context, first provided is a beam having an upper face, a lower face, side faces, and an end face. The end face has a rectangular configuration and is vertically disposed. The end face has a slot vertically disposed and parallel with, and equally spaced from, the side faces. Beam holes extend through the beam on opposite sides of the slot. Next provided is a post having a front face, a parallel rear face, and parallel side faces. A connector is provided having a first section and a second section. Beam apertures are formed in the first section. The first section is positioned in the slot with the beam apertures aligned with the beam holes. The second section is attached to the post. Lastly, dowels are provided extending through the beam holes and the beam apertures thereby coupling the beam to the post. Such components are individually configured and correlated with respect to each other so as to attain the desired objective.

In the preferred embodiment, the post and beam system 10 is designed for coupling a beam 12 to a post 14 and for preparing the post and the beam for coupling. The coupling and the preparing are done in a safe, rapid, accurate, eye-appealing, and economical manner, first provided is a beam 12. The beam has a rectangular cross sectional configuration with four elongated faces 18, 20, 22 and an end face 26. The four elongated faces include a horizontally disposed upper face 18, a parallel lower face 20, and parallel vertically disposed side faces 22. The end face 26 has a rectangular configuration and is vertically disposed. A vertically disposed slot 28 is formed in the end face parallel with, and equally spaced from the side faces. The slot has tapered edges. The tapered edges are optional. Beam holes 30 extend through the beam on opposite sides of the slot.

Next provided is a post 14. The post has a rectangular cross sectional configuration with four elongated faces 32, 34, 36, and an end face. Each of the four elongated faces is vertically disposed. The four elongated faces include a front face 32 and a parallel rear face 34. The four elongated faces also include parallel side faces 36. The end face is vertically disposed and has a rectangular configuration. The post and the beam are fabricated of wood.

Lastly, a connector 42 is provided. The connector has a T-shaped cross sectional configuration and includes a vertically disposed rectangular cross component 44 and a vertically disposed rectangular central component 46. The central component is attached to the cross component at a central extent of the cross component. Screw holes 48 are formed in the cross component on opposite sides of the central component. Screws 50 extend through the screw holes and into the front face 32 of the post. The central component is positioned in the slot with beam apertures 52 aligned with the beam holes. Dowels 54 extend through the beam holes and the beam apertures thereby coupling the beam to the post. One or more of the coupled components, post and/or beam, is preferably fabricated of wood.

Alternatively, one component, such as a floor may be fabricated of concrete, in which case the connector would be attached through threaded fasteners.

In an alternate embodiment 100 of the system, the connector has a cross-shaped cross sectional configuration and includes a vertical component 104 and a horizontal component 106. The beam in this embodiment is two similarly configured beams with end faces 110 in face-to-face contact. Beam slots 112 are formed in the end faces of the beams aligned in a vertical plane. The post has a post slot 114 in the end face of the post. The vertical component of the connector has an upper section 116 positioned in the beam slots. The vertical component of the connector has a lower section 118 located in the post slot. Holes 122 extend through the beams and the post and the connector. Dowels 124 extend through the holes. The horizontal component of the connector is located between the beams above and the post below.

FIGS. 7A and 7B illustrate a connector 128 of an alternate construction. Such connector includes a vertical component 130 with a rectangular upper region 132 and a rectangular lower region 134. A horizontal slot divides the upper and lower regions. Such connector includes a first horizontal component 136 and a second horizontal component 138. The first and second components are similarly configured with laterally exterior regions 140 in a rectangular configuration. The first and second components are each formed with a rectangular projection 142 and a rectangular recess 144. The rectangular projections pass through the horizontal slot and are received in the rectangular recesses thereby forming a component in a cross-shaped configuration, preferably weld free. The various connectors are preferably fabricated of aluminum.

In an alternate embodiment of the invention, a slotting device 200 is included for use with a chainsaw to cut and a workpiece to be cut. The term workpiece is intended to include posts and beams. The chainsaw is of the type having a motor housing portion. A substantially planar guide bar portion rigidly projects from the motor housing portion. A cutting chain portion surrounds a perimeter of the guide bar portion.

The workpiece is first horizontally positioned at a work station. Positioned over the workpiece is a slotting device 206 formed of an upper plate 208 and two similarly configured side plates 210. The upper plate is horizontally positioned for sliding along an upper surface of the workpiece. The side plates are vertically oriented, depending from the upper plate, parallel with sides of the workpiece. Slits 212 are formed in the side plates. The slits receive a chain saw 214 with bolts 216 securing a central cutting guide 218 of the chain saw while allowing movement of a cutting chain 220 while cutting. A handle post 222 is secured above the upper plate in a forward region of the chain saw. A bottoming post 224 is positioned rearwardly of the chain saw to limit horizontal movement of the chain saw and the slotting device with respect to the workpiece. Each side wall has a rearward extension 226 with a horizontally extending opening to allow laterally positioning and securement of the bottoming post as a function of the desired depth of the slot.

FIGS. 12A, 12B, and 12C illustrate an adapter 230. The adapter is removably positioned upon an end of a workpiece to be cut. The adapter is utilized to accommodate a smaller workpiece by positioning the slotting device at an appropriate elevation for a particular application. The preferred configuration of the adapter is in an L-shaped configuration. A long leg 232 is positioned upon the upper surface of the workpiece above the slot. The preferred configuration includes a short leg 234 positioned on an end face of a workpiece above the slot.

The slotting device of the present invention is an improvement over U.S. Pat. No. 4,070,757 issued Jan. 31, 1978 to Granberg, the subject matter of which is incorporated herein by reference.

Another alternate embodiment of the invention includes a cutting guide device 300 for use with a chainsaw and a workpiece 322 having a face to be cut. The chainsaw is of the type having a motor housing portion, a substantially planar guide bar portion rigidly projecting from the motor housing portion, and a cutting chain portion surrounding a perimeter of the guide bar portion.

First provided in this cutting guide device is a rail 323 positioned adjacent to the workpiece and defining a translational axis.

Next, a carriage 334 is provided. The carriage is slidably mounted on the rail and is adapted for constrained translational movement parallel to the translational axis.

A turret 333 is next provided. The turret is attached to the carriage for translational movement therewith and is adapted for pivotal rotation relative to the carriage about a horizontal pivot axis 335 disposed normal to the vertical translational axis.

Next, a chainsaw gripper 336 is provided. The chainsaw gripper is adapted to selectively, rigidly grip the chainsaw by the guide bar portion thereof with a cutting plane defined by the guide bar being vertically oriented and normal to the horizontal pivot axis. The gripper is mounted on the turret for rotation therewith about a horizontal axis while gripping the chainsaw, between a raised position, whereat the guide bar and cutting chain portion of the chainsaw are disposed frontwardly from the face, and a lowered position, whereat the guide bar portion and cutting chain portion intersect the face in cutting relation, thereby to cut the workpiece along the cutting plane.

In this embodiment, an adjustment assembly 350 is provided. The adjustment assembly includes a base component 354 coupled to the rail and a rotatable component 358 coupled to the carriage. A vertically oriented pivot pin 360 couples the rotatable component to the base component. A plurality of threaded holes 370 in the base are equally spaced from the pivot pin. An arcuate slot 362 is provided in the rotatable component with angle indicia. A knob 366 with a threaded bolt extends downwardly through the arcuate slot into a preselected one of the plurality of threaded holes 370 in the base to secure the rotatable component to the base component at a preselected angle.

FIGS. 40-42 show an improved cutting guide device or rotary table. Similar to the device or table described above, this table has a base 314 to which rotatably coupled is a rail 323 preferably approximately 20 inches long. The base is preferably made of aluminum while the elongate rail 323 is preferably HDPE to enhance the slidability of the carriage 334 which is mounted on the rail. The rail defines a translational axis for a carriage 334, turret 333, chainsaw gripper 336 and chain saw similar to those described earlier. The rail 323 rotates around a vertical axis 370 atop the base 314.

The base 314 is has a horizontal base component 354. Pressed into bores in and extending upwardly from the base component 354 are a pair of locating pins 372. A lip 374 depends from one side of the base component 354. In operation, the lip 374 is placed against one side of the beam or workpiece to be cut to locate the base. The lip 374 has at least one and preferably a pair of apertures 376 through which screws 378 can be temporarily screwed into the beam or workpiece to keep the base from moving during the cutting operation.

The rail 323 has a stepped aperture 380 having a major diameter of approximately four inches 382 and a minor diameter 384 to form a shoulder 386. A dial or plug 390, preferably of aluminum, is located in the stepped aperture. The outer diameter of the plug approximates the major diameter 382 of the stepped aperture 380 of the rail so that an outer radial portion of the bottom surface of the plug sits on the shoulder 386 formed in the stepped aperture 380. The bottom of the plug 390 also has a pair of counter bores 396 aligned with and of approximately the same diameter as the pins 372 so that the pins are captured in the counterbores 396, but allowed to slide longitudinally when the plug moves longitudinally. By this construction, the plug 390 can move longitudinally but not rotationally with respect to the base 314.

The plug 390 also has a stepped aperture 392 into which is placed an Allen hex screw 388 that is screwed into a threaded bore 394 in the base. The bottom surface of the head of the Allen hex screw contacts a top surface of the shoulder formed in the stepped aperture 392. The hex screw 388 can be loosened to allow the rail 323 to be rotated about the pivot axis 370 to the proper angle with respect to the base 314 to provide the proper angle for the chain saw to cut a face or slot into the beam or workpiece. In this embodiment, the various angles for defining the relationship of the face to be cut to the longitudinal or transverse axis of the workpiece or beam 322 are defined by angle indicia on the face of the plug 390. In a preferred embodiment, the angle indicia include angles in degrees and also indicia for roof pitch. The proper angle is set by matching the proper angle indicia to a marker on the rail 323 while the hex screw 388 is loosened and the rail 323 is rotated about the base 314 and plug 390 and maintained when the hex screw 388 is tightened. In one operation a perpendicular end face can be cut on a beam by setting the angle at 0 degrees as shown in FIG. 41 with the lip 374 abutting the side of the beam and the chain saw cutting completely through the beam. End faces of other angles can be formed by adjusting the relationship of the rail 323 to the base 314. In another operation, a slot can be cut part of the way through the beam when the angle is set at something between 0 and 90 degrees and the chain saw is moved only part of the way into the beam. If the base is moved and the rail 323 is then set at a complementary angle, it can be appreciated that the initial slot can end up being a triangular notch if the chain saw is again moved only part of the way into the beam.

The beam slotting device of the present invention is an improvement over U.S. Pat. No. 6,192,592 issued Feb. 27, 2001 to Zimmerman, the subject matter of which is incorporated herein by reference.

FIGS. 23-25 illustrate a connector of an alternate construction 400. Such connector is employed for coupling adjacent first and second rafters 404, 406 supporting a roof. Rafters coupled together are usually called trusses. The first and second rafters are supported at an angle in an inverted V-shaped configuration meeting at an apex 408. The first and second rafters are supported from below by a load bearing post 410 with an inverted V-shaped upper edge in contact with the first and second rafters adjacent to the apex. A vertical slot 412 is formed in the first and second rafters extending through the apex and depending into the load bearing post. The slot includes a cylindrical enlargement 414 in the load bearing post adjacent to a lower end of the slot.

Within the slot is hardware. The hardware includes a block 418, a bolt 420, a cylinder 422, and two pins 424. The bolt has a headed end above and a threaded end below. The cylinder has an axially disposed threaded aperture receiving the threaded end of the bolt. The block has on unthreaded bore slidably receiving a central extent of the bolt. The block also has two angled slots 426 in an inverted V-shaped configuration. The two pins extend through the first and second rafters respectively. The pins are slidably received in the slots respectively whereby rotation of the head end of the bolt will lower the block moving the pins inwardly to more securely bring the rafters together at the apex. In addition, rotation of the head end of the bolt will more securely bring together the rafters and the load bearing post.

The present invention may be considered the components to be coupled and/or the couplers and/or the hardware coupling the rafters and/or the tools to accurately cut and/or drill the components to be coupled.

The invention also comprises a new and novel slotting cutting device 500 generally shown in FIGS. 27-39. The slotting cutting device 500 allows one assembly to both cut slots in the longitudinal axis of the beam as well as cut off the end of a beam along a transverse axis to the beam to create a beam of pre-determined length. As shown in FIGS. 27-29, the slotting cutting device 500 includes a chain saw 214 having a motor and housing, a central cutting guide or bar 218 and cutting chain 220. An adjustable bar clamp 502 is adjustably fixed or clamped to the central cutting guide so that it can be positioned at designated locations along the central cutting guide 218. In one embodiment, as shown in FIG. 29, the adjustable bar clamp 502 is clamped to the central cutting guide be means of a pair of screws 504. Each screw includes a head 506 and threads 508. In this embodiment, the threads 508 of the screws cooperate with internal threads 520 in a pair of apertures 510 in the right side 520 of the adjustable bar clamp. When the screws are tightened, the distal ends 512 of the screws contact one side of the central cutting guide 218 to pin the other side of the guide 218 against a raised portion 514 of the left side 516 of the interior opening 518 of the adjustable bar clamp 502. In one embodiment, the screws may also have lock nuts or other means to maintain consistent torque of the screws on the central cutting guide 218.

The adjustable bar clamp 502 and clamped chain saw 214 pivot within an internal opening 522 of the slider 524. The slider comprises a front plate 534 into which the internal opening 522 is cut and a pair of vertical side walls 536. In one embodiment, the pivot axis 528 is formed by a co-axial pair of pins 526 extending through co-axial apertures 530 and 532 in the adjustable bar clamp 502 and the vertical side walls 536 of the slider 524.

The front plate 534 of the slider also has sideward extensions 538 that extend beyond the side walls 536. These extensions 534 slidably fit within a pair of parallel spaced shoulders 540 that are mounted on the back face 542 of a vertical mounting plate 544. By this construction the slider 524, adjustable bar clamp 502 and chain saw 214 can translationally move along the back face 542 of the vertical mounting plate 544.

The vertical mounting plate 544 is preferable made of aluminum, steel or rigid plastic such as HDPE and also has a front face 546 that is adapted to contact the beam 12. The vertical mounting plate 544 also comprises a vertical slot 548 adapted to be wide enough to allow the cutting chain 220 to pass through without contact. The vertical slot 548 is positioned between the shoulders 540 so that when the chain saw 214, adjustable bar clamp 502 and slider 524 assembly slide along the back face 542 of the mounting plate 544, the extension 550 of the central cutting guide 218 and chain 220 pass through the vertical slot 548 and can cut into the beam 12.

In one embodiment, the vertical mounting plate 544 also has at least one aperture 552 to accept screws for temporarily affixing the mounting plate to the beam 12 while the slotting cutting device 500 is in use. In a preferred embodiment, there are three apertures 552 so the plate can be affixed in various positions. Also in a preferred embodiment, the apertures have shoulders so the heads of the mounting screws (not shown) are flush with the back face 542 of the vertical mounting plate 544 and do not interfere with the slider 524 as it moves along the mounting plate 544 as seen in FIGS. 36-39. In a preferred embodiment, the mounting plate also has a positioning bar 554 with two portions, each extending normal to the slot on the front face 546. The positioning bar contacts one of the top, bottom or side faces 18, 20 or 22 of the beam to help position the mounting plate on the beam. Extending from one end of the positioning bar 554 is an adjustable locating guide 556 so the slotting cutting device can be used with beams of different dimensions. The adjustable locating guide comprises a locating plate transversely mounted to a rod 560 that is slidably mounted in a longitudinal bore 562 in the positioning bar 554. A fixing knob and screw 564 fix the rod 560 at a desired length of rod extending from the bore. The rod 560 can be pre-marked with indicia showing the correct length of rod extending from the bore to position the slot 548 at the proper location medially between the side faces of the beam 12 depending on the beam dimensions. The locating plate 558 can also be rotated upwardly and out of the way when not needed.

As can be appreciated, by this construction, the slotting cutting device can both cut a slot into the end face 26 of a beam 12 as well as cut off the end portion of a beam 12 to cause the remainder of the beam to be the correct length. As a slotting device, first, the locating guide 556 must be properly positioned for the dimensions of the beam. The location plate 558 butts up against the side wall of the beam and the positioning bar 554 is placed on the top of the beam with the mounting plate 544 placed against the end face 26 of a beam 12. The slot 548 is medially located between the side walls of the beam so the resulting slot 566 in the beam 12 is properly located between the side walls of the beam.

The adjustable bar clamp 502 is properly positioned and clamped on the central cutting guide so the extension 550 of the cutting guide is the proper length for making a slot 566 of proper depth. As shown in FIGS. 36 and 37, the chain saw, adjustable mounting clamp and slider are then lowered through the parallel shoulders 540 while the chain saw is operating and cutting the resulting slot 566. This translational movement is limited by a lower cross bar 568. In addition to the translational movement of the chain saw along the mounting plate 544, the chain saw can also pivot about the pivot axis 528 to enhance the cutting ability of the chain. However, in order to ensure that the slot 566 had the proper depth, the chain saw must be horizontal at some point so the extension 550 reaches its full depth into the beam. The slot may also subsequently have tapered or chamfered edges applied to it for accommodation of the connector 42.

As shown more fully in FIGS. 38 and 39, the slotting cutting device can also cut through a beam transversely. Initially, a transverse pencil or chalk line is drawn on a side face 22 or top face of the beam 12 at the correct location to create a beam of proper length. The mounting plate 544 is then located on the side face 22 of the beam 12. The vertical slot 548 is lined up with the predetermined pencil or chalk line and the mounting plate is lowered so the positioning bar 554 rests on the top face 18 of the beam. Preferably, screws are screwed into the left two apertures 552 of the mounting plate 544 to hold it in the proper position. The adjustable bar clamp 502 is clamped onto the central cutting guide at a location that will allow the cutting bar extension 550 to pass entirely through the beam 12. The chain saw is then turned on and the chain saw 214, adjustable bar clamp 502 and slider 524 assembly are moved translationally along the back face of the mounting plate and pivotally around the pivot axis to allow the chain to cut through the beam.

The present invention is a new concept that greatly simplified the construction of post and beam buildings by eliminating traditional labor-intensive methods. Various sizes are provided. The connectors match the dimensions of the timbers specified in a user's plans. Time and money is saved using provided plans and connectors. The job is quicker, stronger and less expensive using the present invention. The connectors are versatile for use in cabins, studios, barns, workshops, gazebos, pergolas, car barns, deck railing, and any addition. Timber framing is made easier and faster. The designs are engineer-approved. Custom plans are available. All tooling necessary is provided.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A beam cutting guide device for use in cutting a horizontally oriented beam having a top face, bottom face and a pair of side faces, with a chainsaw, the chainsaw being of the type having a motor housing, a substantially planar guide bar rigidly projecting from the motor housing and a cutting chain surrounding a perimeter of the guide bar, the cutting device comprising: a base having a horizontal base component and a depending lip adapted to contact one of the side faces of the beam and having at least one aperture adapted to allow a fastener to pass there through and into the one side face of the beam for affixing the base to the beam, an elongated rail having a longitudinal axis, a rectangular cross-section, a flat top surface and rotationally mounted on the base component about a vertical pivot axis, a carriage slidably mounted on the rail and adapted for constrained translational movement parallel to the rail longitudinal axis, a turret attached to the carriage for translational movement therewith and adapted for pivotal rotation relative to the carriage about a horizontal pivot axis disposed normal to the rail longitudinal axis, a chainsaw gripper adapted to selectively, rigidly grip the chainsaw by the guide bar with a cutting plane defined by the guide bar being vertically oriented and normal to the horizontal pivot axis, the gripper being mounted on the turret for rotation therewith about the horizontal pivot axis while gripping the chainsaw between a raised position, wherein the guide bar and cutting chain of the chainsaw are disposed away from the beam, and a lowered position, wherein the guide bar and cutting chain intersect the beam in cutting relation, thereby to cut the beam along the cutting plane, and an adjustment assembly including a plug having a top surface and mounted in a recess in the rail above the base for limited axial movement and no rotational movement with respect to the base component, and a downwardly depending screw coaxial with the vertical pivot axis and extending through an aperture in the plug that is also coaxial with the vertical pivot axis, through an aperture in the rail and threadedly into an aperture in the base, the screw also having a head, with the head constraining the plug to the base component and sandwiching the rail, wherein in an adjustment condition the screw is loosened and the rail is allowed to rotate about the vertical pivot axis and a cutting condition wherein the screw is tightened and the rail is fixed between the plug and the base component and the top surface of the plug and the head of the screw do not extend above the top surface of the rail so the carriage can slide along the rail and over the plug and the screw.

2. The beam cutting device of claim 1 wherein the plug is constrained from rotational movement with respect to the base by at least one pin fixed in the base and extending into a bore in the plug so that in the adjustment condition, the rail is configured to rotate with respect to the base, but the plug is fixed with respect to rotational movement to the base, and one of the rail and the plug has a line on its top surface pointing toward the vertical pivot axis and the other of the rail and the plug has angle indicia that cooperate with the line to display the relative angle between the plug and the rail.

3. The beam cutting device of claim 2 wherein the chainsaw can be pivoted about the horizontal pivot axis and translated along the rail longitudinal axis to effect cutting of the beam.

4. The beam cutting device of claim 3 wherein the angle indicia corresponds to a roof pitch.

5. The beam cutting device of claim 2 wherein the rail is rotated about the vertical pivot axis to an angle less than 90 degrees to the longitudinal axis of the beam in the adjustment condition and then fixed in that orientation, and the chainsaw is held in a vertical condition in the cutting condition and the carriage is slid along the rail to create an angled cut in one side of the beam.

6. The beam cutting device of claim 5 wherein the chainsaw cuts less than entirely through the beam in the cutting condition by the operator.

7. The beam cutting device of claim 5 wherein the angle is defined by aligning the line with one of the angle indicia.

8. The beam cutting device of claim 2 wherein the indicia are on the plug and the line is on the rail.

9. The beam cutting device of claim 8 wherein the beam has a first end and a second end and the depending lip contacts and is affixed to a first side face of the pair of side faces of the beam, and in the adjustment condition, the line on the rail is aligned with the 0 degree indicia on the plug and the cutting plane is transverse to the faces of the beam so that in the cutting condition the chain saw can cut off one of the first or second ends of the beam.

10. The beam cutting device of claim 1 wherein the at least one aperture comprises a pair of apertures in the depending lip with each aperture adapted to accept a fastener comprising a screw for affixing the base to the beam.

11. The beam cutting device of claim 1 whereat in the cutting condition, the head of the downwardly depending screw is located in a recess in the plug.

* * * * *